US005486905A

United States Patent [19]

Takeda et al.

[11] Patent Number: 5,486,905

[45] Date of Patent: Jan. 23, 1996

[54] DEVELOPING AGENT RECOVERY APPARATUS AND IMAGE FORMING APPARATUS USING SUCH RECOVERY APPARATUS

[75] Inventors: Atsushi Takeda; Michiro Koike, both of Kawasaki; Hironobu Saito, Yokohama; Toru Katsumi, Kawasaki, all of Japan

[73] Assignee: Canon Kabushiki Kaisha, Tokyo, Japan

[21] Appl. No.: 188,883

[22] Filed: Jan. 31, 1994

[30] Foreign Application Priority Data

| | | | |
|---|---|---|---|
| Feb. 1, 1993 | [JP] | Japan | 5-034008 |
| May 10, 1993 | [JP] | Japan | 5-108231 |
| Jun. 29, 1993 | [JP] | Japan | 5-158964 |

[51] Int. Cl.[6] ..... G03G 21/00

[52] U.S. Cl. ..... 355/215; 355/298

[58] Field of Search ..... 355/215, 245, 355/269, 296, 298

[56] References Cited

U.S. PATENT DOCUMENTS

| | | | |
|---|---|---|---|
| 4,389,968 | 6/1993 | Satomura . | |
| 4,403,852 | 9/1983 | Hirabayashi et al. | 355/298 X |
| 4,470,694 | 9/1984 | Murakami et al. | 355/298 X |
| 4,601,569 | 7/1986 | Garris . | |
| 4,708,455 | 11/1987 | Kubota et al. . | |
| 5,153,642 | 10/1992 | Folkins et al. | 356/215 |
| 5,289,249 | 2/1994 | Yamamoto et al. | 355/298 |

FOREIGN PATENT DOCUMENTS

| | | | |
|---|---|---|---|
| 0030832 | 3/1979 | Japan | 355/298 |
| 56-207186 | 3/1981 | Japan . | |
| 56-74284 | 6/1981 | Japan . | |
| 56-140386 | 11/1981 | Japan . | |
| 56-165180 | 12/1981 | Japan . | |
| 57-118287 | 7/1982 | Japan . | |
| 57-167069 | 10/1982 | Japan . | |
| 58-184984 | 10/1983 | Japan . | |
| 58-184983 | 10/1983 | Japan . | |
| 59-058458 | 4/1984 | Japan . | |
| 0088763 | 5/1984 | Japan | 355/298 |
| 59-137972 | 8/1984 | Japan . | |
| 59-143180 | 8/1984 | Japan . | |
| 60-257478 | 12/1985 | Japan . | |
| 60-256169 | 12/1985 | Japan . | |
| 61-46572 | 3/1986 | Japan . | |
| 0211913 | 1/1990 | Japan . | |

OTHER PUBLICATIONS

European Search Report dated Jun. 3, 1994.

*Primary Examiner*—Sandra L. Brase

*Attorney, Agent, or Firm*—Fitzpatrick, Cella, Harper & Scinto

[57] ABSTRACT

A developing agent reproducing apparatus, including a recovery device for recovering; a developing agent from a mixture of the developing agent and foreign substances, the recovery device having an attracting member for attracting the developing agent and a filter for preventing substances other than the developing agent of the mixture from passing therethrough. The filter is disposed in a region in which the developing agent is moved by the attracting member and the attracting member is disposed upstream of the filter in a gravity working direction.

20 Claims, 18 Drawing Sheets

DEVELOPING AGENT RECOVERY APPARATUS AND IMAGE FORMING APPARATUS USING SUCH RECOVERY APPARATUS

BACKGROUND OF THE INVENTION

1. Field of the Invention

The present invention relates to both a developing agent reproducing or recovery apparatus, for recovering; a developing agent from a mixture of the developing agent and a foreign substance, and an image forming apparatus using the developing agent recovery apparatus.

2. Related Background Art

After a developing agent is transferred from an image carrier to a recording member, the residue that resides on the image carrier is usually removed by a cleaning blade or the like and then disposed of as waste substances.

From resource recycling point of view, a developing agent reproducing apparatus that separates a developing agent from the residue, an apparatus that uses the reproduced developing agent, and the similar apparatuses have been proposed. In particular, various simple construction types of developing agent reproducing apparatuses with a mesh-shaped filter that allows only a developing agent to pass therethrough, thereby to separate it from other foreign substances, have been proposed.

However, when a developing agent is separated from other foreign substances by using a filter, and in particular, a mesh-shaped filter, the mesh of the filter will be clogged with foreign substances such as paper powder. When small foreign substances are removed, a small mesh is used for the filter. However, in this case, the filter tends to be clogged.

Thus, since such reproducing apparatus must be frequently maintained, it is difficult to practically use the apparatus.

SUMMARY OF THE INVENTION

The present invention has been made from the above-mentioned point of view. An object of the present invention is to provide a developing agent reproducing or recovery apparatus that prevents a filter from being clogged, to prolong maintenance intervals of the apparatus, and to provide an image forming apparatus using such a developing agent recovery apparatus.

Another object of the present invention is to provide both a developing agent recovery apparatus with an attracting member that is disposed upstream of a filter in a gravity working direction and attracts a developing agent contained in a residue removed from an image carrier, and an image forming apparatus using such a developing agent recovery apparatus. A further object of the present invention is to provide both a developing agent recovery apparatus comprising a conveying means for conveying a residue removed from an image carrier and having a pair of magnetic field generating members and a filter for preventing substances other than a magnetic toner from passing therethrough and being disposed between the pair of magnetic field forming members, and an image forming apparatus using such a developing agent recovery apparatus.

These and other objects, features and advantages of the present invention will become more apparent in light of the following detailed description of best mode embodiments thereof, as illustrated in the accompanying drawings.

DETAILED DESCRIPTION OF PREFERRED EMBODIMENTS

Figure 1:
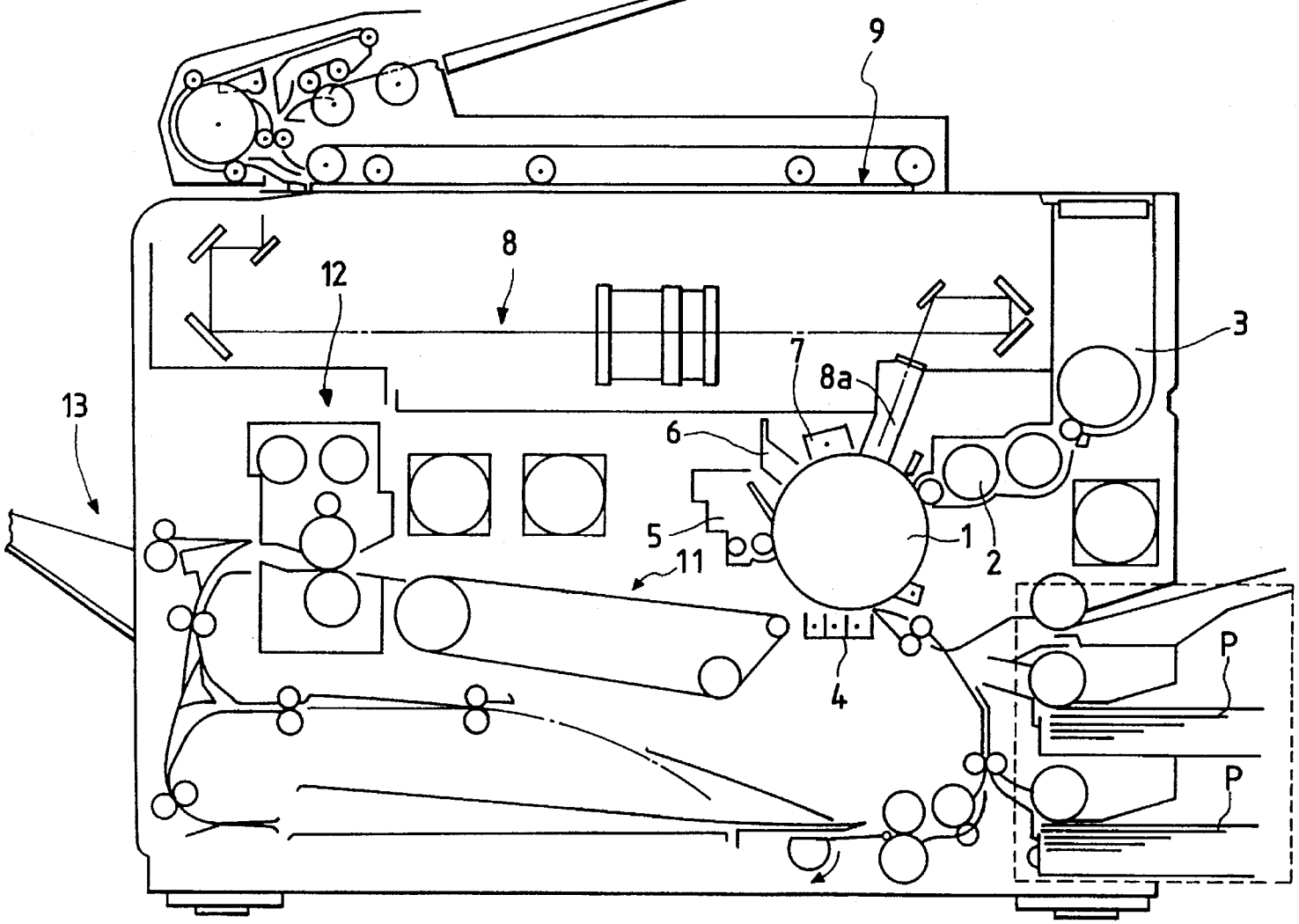
FIG. 1 is a sectional view schematically showing an image forming apparatus according to the present invention.
Figure 2:
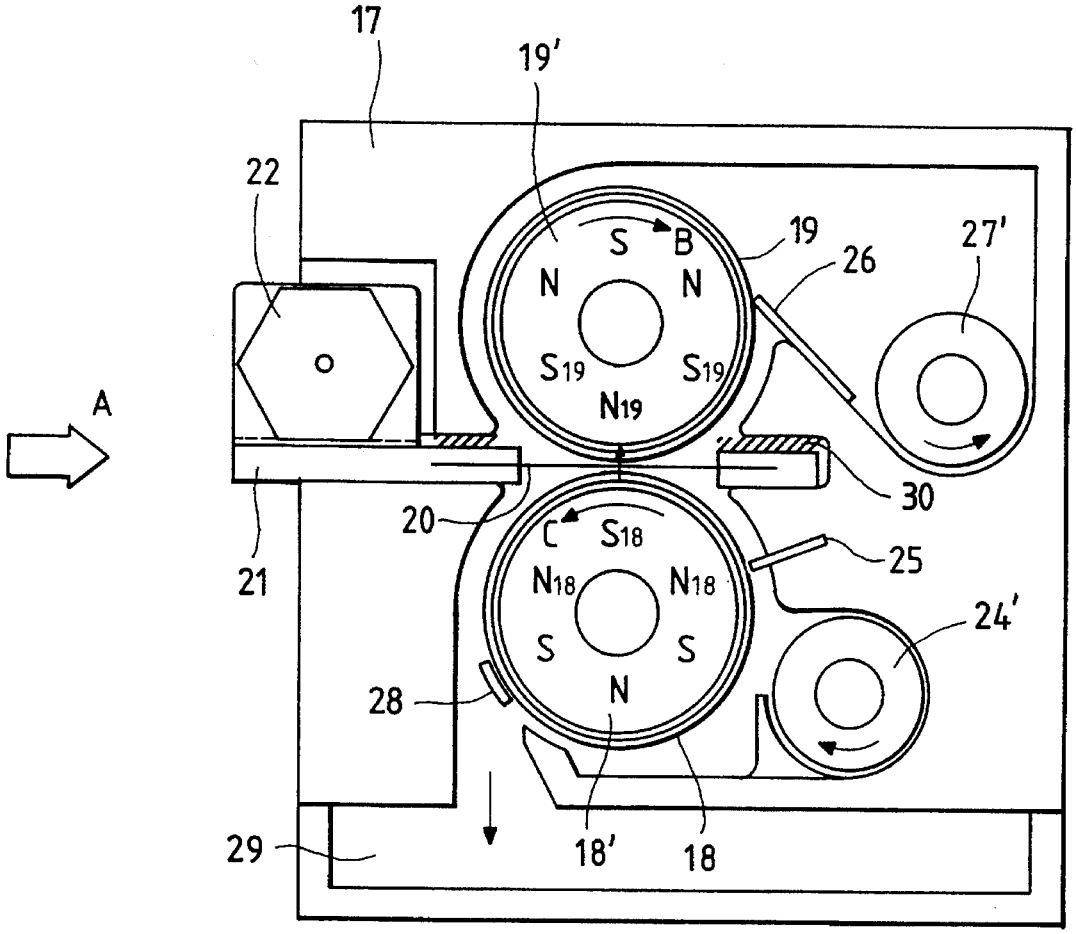
FIG. 2 is a sectional view showing a construction of the developing agent reproducing apparatus.
Figure 3:
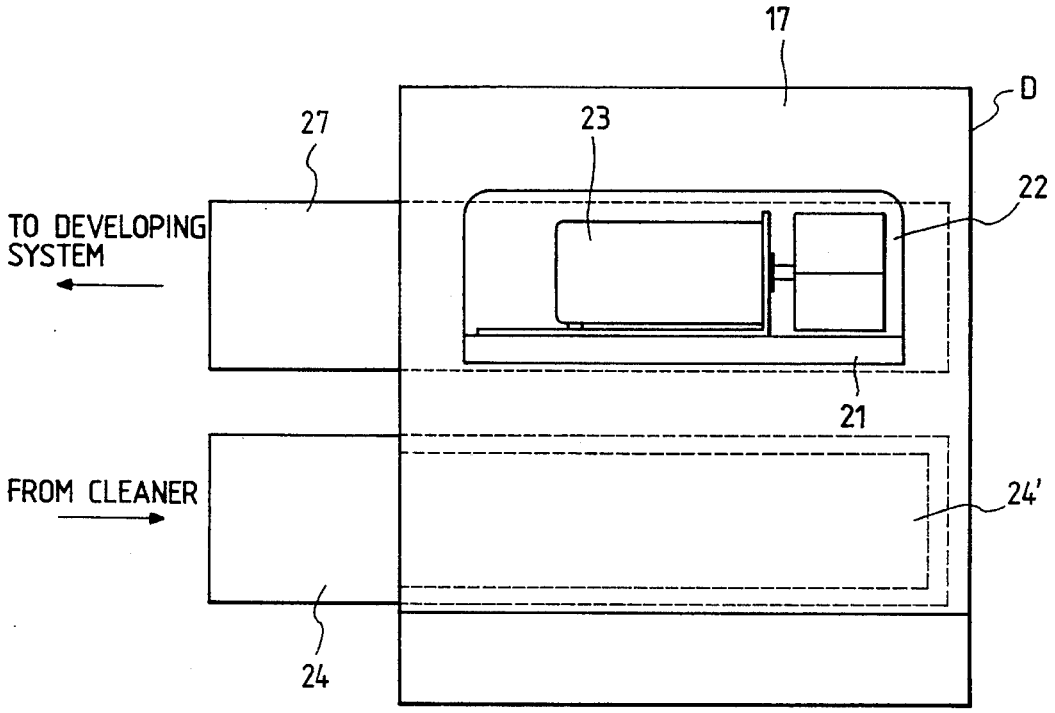
FIG. 3 is a side view showing the developing agent reproducing apparatus.
Figure 4:
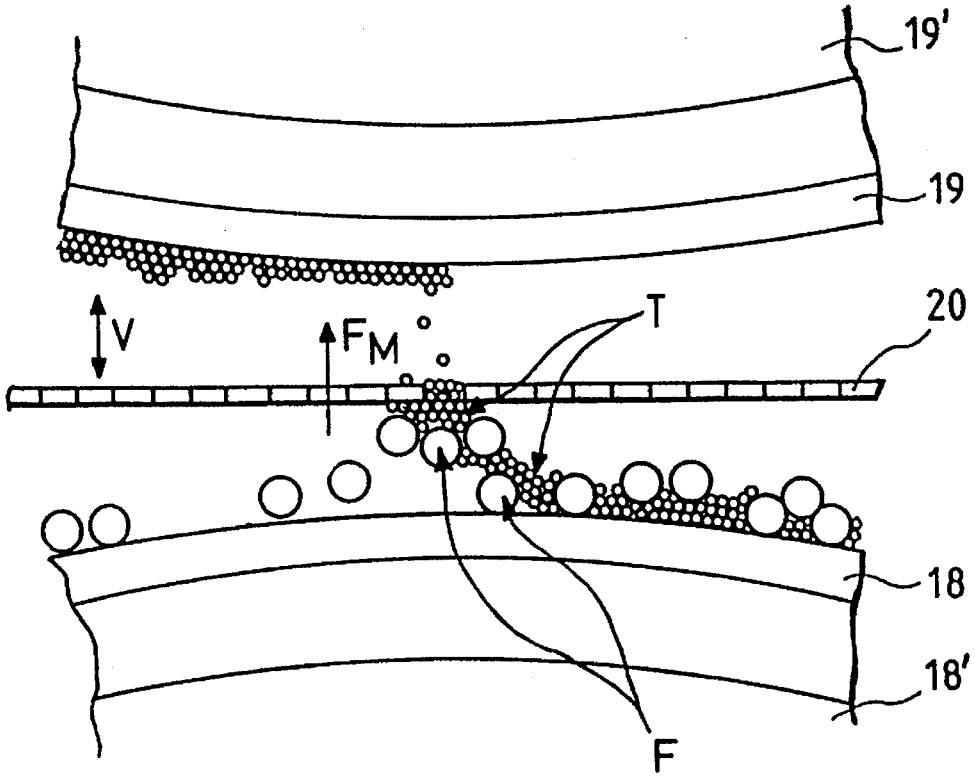
FIG. 4 is a sectional view showing a developing agent that is separated from non-magnetic substances (foreign substances) by the developing agent reproducing apparatus.

FIG. 1 is a sectional view schematically showing an image forming apparatus according to the present invention. FIG. 2 is a sectional view showing a construction of a developing agent reproducing apparatus that separates a developing agent from a residue removed from an image carrier. FIG. 3 is a side view showing the developing agent reproducing apparatus viewed from arrow A of FIG. 2. FIG. 4 is a sectional view of the developing agent reproducing apparatus that separates a magnetic toner T from non-magnetic substances F (foreign substances).

Next, an image forming process of the image forming apparatus will be described.

A photosensitive member (image carrier or image bearing member) 1 that is rotated is uniformly charged by a charger 7. The photosensitive member 1 is exposed (by an optical system 8) with rays 8*a* corresponding to an image of an original document placed on a document table 9. Thus, a static latent image is formed. The latent image is visualized or developed by a developing unit 2 with a single component developing agent composed of a magnetic toner. The toner image formed on the photosensitive member 1 is transferred to a recording member P by a transfer charger 4. The recording member P having the toner image is conveyed to a fixing unit 12 by a conveying belt 11. The fixing unit 12 fixes the toner image on the recording member P. Thereafter, the recording member P is unloaded to a paper output tray 13. After the toner image is transferred, a residual toner, paper powder, and the like reside on the photosensitive member 1. The residue is removed by a cleaning unit 5. Thereafter, the photosensitive member 1 is exposed to rays radiated from an exposing unit 6 and thereby the photosensitive member 1 is discharged. Thus, image forming process is prepared.

The image forming apparatus shown in FIG. 1 removes foreign substances such as paper powder from the residue removed by the cleaning unit 5. Only the residual toner (magnetic toner) is conveyed to a hopper 3 of the developing unit 2 and reused. Next, with reference to FIGS. 2 to 4, a developing agent reproducing apparatus according to a first embodiment of the present invention will be described.

The developing agent reproducing apparatus comprises a frame 17, a rear end portion (hatched portion of FIG. 3) of a conveying path 24 having a conveying screw 24', a sleeve 18 that holds the residue and rotates in the direction of arrow C, a magnet 18' fixed in the sleeve 18 (so that $S_{18}$ pole always faces upward as shown in FIG. 2), a restricting member 25 that restricts the thickness of the layer of the residue held on the sleeve 18, a sleeve 19 that attracts a toner from the sleeve 18 (the sleeve 19 rotates in the direction of arrow B), a magnet 19' (attracting member) fixed in the sleeve 19 (so that $N_{19}$ pole always faces downward as shown in FIG. 2), a scrape-off blade 26 that scrapes off the toner from the sleeve 19, a forward end portion of a conveying path 27 having a conveying screw 27' that conveys the scraped toner to a developing hopper, a mesh-shaped filter (composed of non-magnetic stainless steel lines, non-magnetic brass lines, nylon fibers, or the like) 20, and a sealing member 30 that prevents toner and the like from leaking out.

Next, a separating method of the developing agent reproducing apparatus that separates a magnet toner from other foreign substances will be described.

The conveying screw 24' in the conveying path 24 extends in the vicinity of an inner surface (surface D of FIG. 3) of the frame 17 in parallel with the sleeve 18. The conveying path 24 has an opening on the sleeve 18 side. Thus, the residue (foreign substances such as magnetic toner and paper powder) that have been conveyed by the conveying screw 24' are attracted to the front surface of the sleeve 18 by the magnetic force of the magnet 18' disposed in the sleeve 18. (At this point, the foreign substances such as non-magnetic paper powder are mixed with the magnetic toner. Thus, the foreign substances are attracted to the front surface of the sleeve 18 along with the magnetic toner).

The thickness of the residue adhered to the front surface of the sleeve 18 is restricted by the doctor blade 25. As the sleeve 18 is rotated, the residue is conveyed to an opposed region of the sleeves 19 and 28 where the toner is separated from the foreign substances (namely, the region where the magnetic force of the sleeve 19 satisfactorily affects the residue). The residue conveyed to the separating portion opposed to the sleeve 19 is effectively attracted to the sleeve 19 by converged magnetic lines of force extending from a magnetic pole S18 to a magnetic pole N19. The magnetic forces $F_m$ of the magnetic poles N19 and S18 at the separating portion have the relation N19>S18. Thus, the toner is strongly attracted upwardly through the openings of the mesh 20 by the magnetic pole N19. The mesh 20 has openings that are several times larger than the diameter of toner particles. (When a toner with average particle diameter of 5 μm to 20 μm is used, the mesh should preferably have openings of 37.5 μm sq (#400) to 50 μsq (#100). Thus, the toner easily passes through the mesh 20, whereas paper powder that is attracted do not pass through the mesh 20. Thus, since the paper powder is restricted by the surface of the sleeve 18, it drop to the sleeve 18 by its dead weight. The paper powder is held by the sleeve 18. Thus, foreign substances such as paper powder are conveyed to a non-magnetic contacting member 28 along with the residual toner that has not been attracted to the sleeve 19 and the residual foreign substances that have not floated. The non-magnetic contacting member 28 scrapes off these foreign substances from the front surface of the sleeve 18. The non-magnetic contacting member 28 is lightly contacted with the sleeve 18. Thus, the non-magnetic contacting member 28 can scrape off foreign substances such as paper powder that adhere to the sleeve 18 with a weak force. However, since the toner that has not been removed by the separating portion is attracted to the sleeve by the magnetic force, it cannot be scraped off by the non-magnetic contacting member 28. As the sleeve is rotated, the same separating process is repeated. Thus, most of the developing agent is not collected in a foreign substance collecting portion 29. In other words, the collecting portion 29 collects only foreign substances most of which are non-magnetic substances.

Since the sleeve 19, which is a developing agent attracting member, is disposed upstream of the filter 20 in the gravity working direction, foreign substances such as paper powder drop from the filter by their dead weight. Thus, the developing agent reproducing apparatus according to this embodiment can properly separate a developing agent from other foreign substances without occurrences of clogging of the filter.

In this embodiment, the mesh 20 is vibrated by a cam 22 connected to a drive motor 23 through a supporting member 21 that holds the mesh 20. The frequency and amplitude of the vibrations are preferably 50 Hz or higher and 0.2 to 4 mm, respectively. Some toner particles contained in the residue may be aggregated. The aggregated toner particles may adhere to the openings of the mesh 20. In particular, when relative humidity is high, the toner particles tend to be aggregated and adhere to the openings of the mesh 20. Thus, the mesh 20 may become clogged.

When the aggregated toner particles that adhere to the mesh 20 are vibrated, they are destroyed, thereby preventing the mesh 20 from being clogged (see FIG. 4). When a magnetic force that attracts the developing agent is much stronger than the dead weight of the developing particles, they are easily attracted to the sleeve 19 disposed upstream of the mesh 20 in the gravity working direction. In this embodiment, since the magnetic toner is conveyed from the downstream side to upstream side in the gravity working direction, and separated from non-magnetic substances, the non-magnetic substances (foreign substances) separated from the magnetic toner adhere to the lower surface of the mesh. Thus, the non-magnetic substances drop by their dead weight and the vibrations V applied to the mesh. In this manner, the magnetic toner can be effectively separated from the foreign substances. In addition, the mesh can be continuously prevented from clogging. As the sleeve 19 is rotated, the magnetic toner that has been separated from the paper powder and attracted to the sleeve 19 is conveyed to the scrape-off blade 26. The magnetic toner scraped off is conveyed by the screw 27 to the outside of the developing agent reproducing apparatus. The magnetic toner separated is conveyed to a developing system by a conveying unit (not shown) and then used for the developing process.

Figure 5:
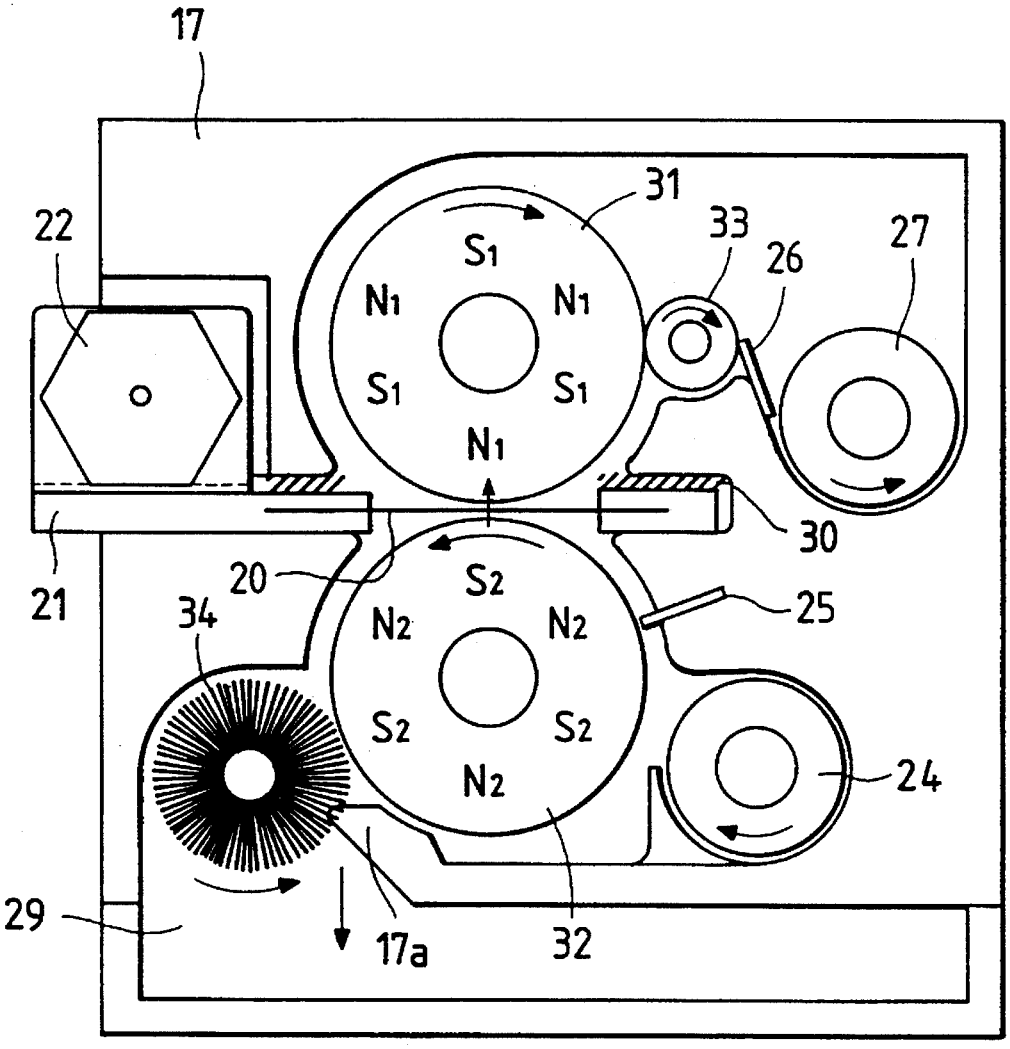
FIG. 5 is a sectional view showing a developing agent reproducing apparatus according to a second embodiment of the present invention.

FIG. 5 shows a developing agent reproducing apparatus according to a second embodiment of the present invention. In FIG. 5, reference numerals 31 and 32 are magnet rollers that are disposed so that opposite magnetic poles are opposed at their opposed portions. The magnetic poles (N1 and S1) of the magnet roller 31 and the magnetic poles (N2 and S2) of the magnet rollers 32 have the relations of N1>S2 and S1>N2. The magnetic poles of the magnet rollers 31 and 32 are disposed at predetermined angles and rotated by a drive source (not shown) at the same speed so that the magnetic poles of the opposed magnet rollers 31 and 32 have opposite polarity. Next, the operation of the developing agent reproducing apparatus according to the second embodiment will be described. After residue is removed from the photosensitive drum, the thickness of the residue that adheres to the surface of the magnet roller 32 is restricted by a doctor blade 25. The residue is conveyed to the separating portion. A magnetic toner is effectively attracted to a magnet roller 31 by converged magnetic lines of force generated by the opposed magnetic poles. Since the magnetic forces N1 and S1 on the upper side are larger than the magnetic forces N2 and S2 on the lower side, the magnetic toner is attracted upwardly through openings of a mesh 20 to magnetic poles N1 and S1. As in the first embodiment, the magnetic toner is separated from foreign substances by the mesh 20. In addition, a scrape-off roller 33 that is made of a magnetic material is contacted with the magnet roller 31. Thus, the magnetic toner that adheres to the front surface of the magnet roller 31 is attracted to the scrape-off roller 33. The magnetic toner is scraped off by a scrape-off blade 26 contacted to the scrape-off roller 33. The magnetic toner separated from the foreign substances is conveyed to the outside of the developing agent reproducing apparatus by a conveying screw 27. The foreign substances such as paper powder that have dropped from the openings of the mesh 20 are held on the magnet roller 32. The foreign substances are conveyed as the magnet roller 32 is rotated. The non-magnetic foreign substances are scraped off by a protruding portion 17*a* to a collecting portion 29. At this point, the magnetic toner that has not passed through the openings of the mesh 20 and has been held on the magnet roller 32 is conveyed to a downward section, not scraped off by a cleaning brush 34. As the sleeve is rotated, the same separating process is repeated. Thus, most of the magnetic toner is not collected into collecting portion 29. In other words, the collecting portion 29 collects only foreign substances, most of which are non-magnetic substances.

In the second embodiment, a separating process for separating a single component developing agent containing a magnetic toner from other foreign substances was described. However, it should be noted that the present invention is not limited to such a developing agent. Instead, the present invention can be applied to a developing agent containing a non-magnetic toner or a dual-component developing agent. In other words, the present invention can be applied to a construction where foreign substances other than a developing agent drop from a filter by their dead weight. However, when a non-magnetic toner is reproduced, a member that attracts the toner through a filter should generated other than a magnetic force.

In the second embodiment, a filter was disposed in a gravity working direction (in other words, nearly in parallel with the installation plane of the image forming apparatus). However, it should be appreciated that the present invention is not limited to such a construction. Instead, as long as foreign substances such as paper powder drop from the filter by their dead weight, the installation angle of the filter is not limited to that in the second embodiment.

Figure 6:
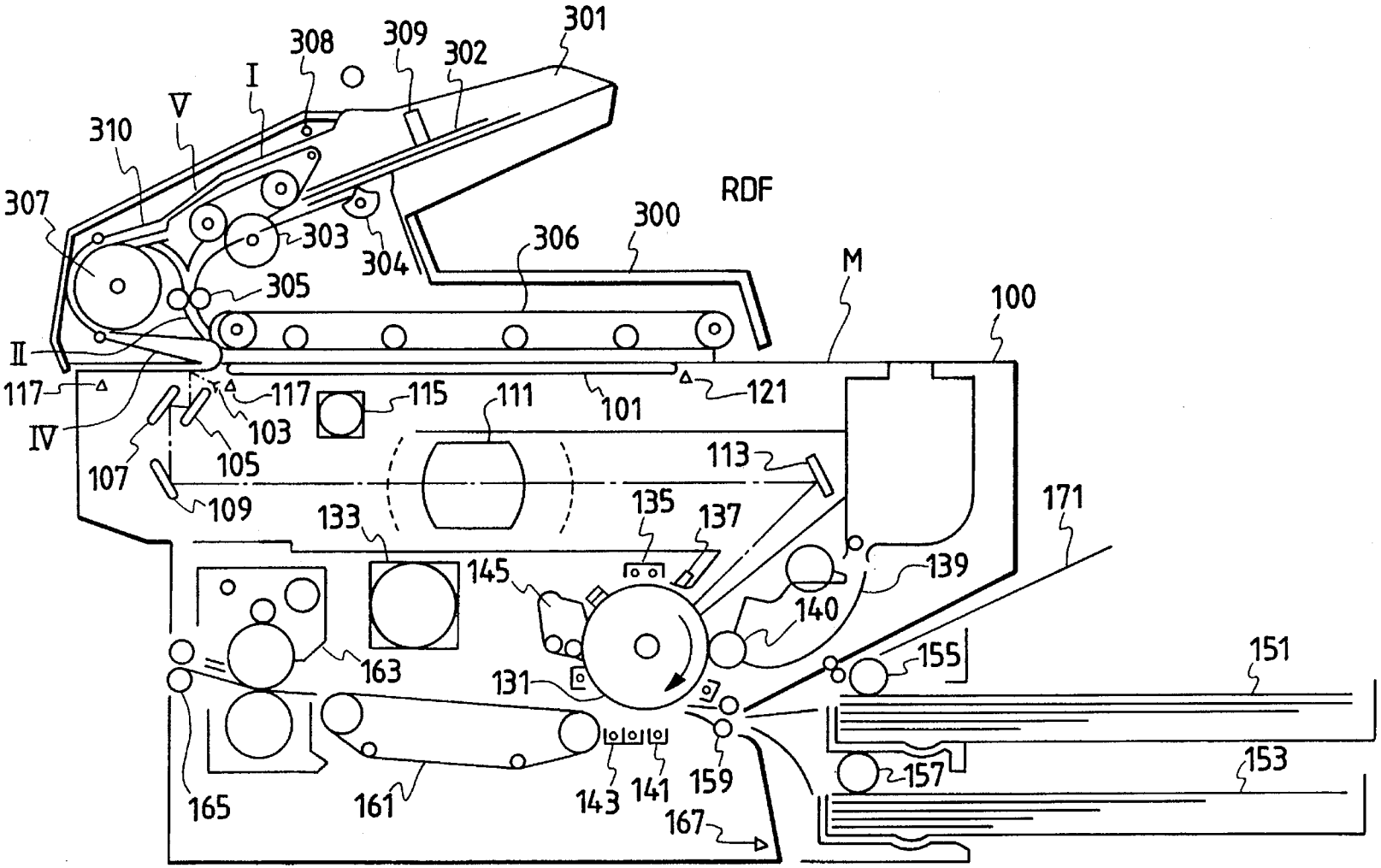
FIG. 6 is a sectional view showing an image forming apparatus according to a third embodiment of the present invention.

Next, a third embodiment of the present invention will be described. FIG. 6 is a sectional view schematically showing an image forming apparatus with a developing agent reproducing apparatus according to the third embodiment.

As shown in FIG. 6, reference number 101 is a document table glass on which an original document is placed. Reference numeral 103 is a lamp that illuminates the original document (exposing lamp). Reference numerals 105, 107, and 109 are scanning and reflecting mirrors (scanning mirrors) that changed optical paths of rays of light reflected from the original document. Reference numeral 111 is a lens with focusing and zooming functions. Reference numeral 113 is a fourth reflecting mirror (scanning mirror) that changes an optical path. Reference numeral 115 is a motor that drives an optical system. Reference numerals 117, 119, and 121 are sensors.

Reference numeral 131 is a photosensitive drum. Reference numeral 133 is a main motor that drives the photosensitive drum 131. Reference numeral 135 is a high voltage unit. Reference numeral 137 is a blank exposing unit . Reference numeral 139 is a developing unit. Reference numeral 141 is a transferring charger. Reference numeral 143 is a separating charger. Reference numeral 145 is a cleaning unit.

Reference numeral 151 is a upper cassette. Reference numeral 153 is a lower cassette. Reference numeral 171 is a manual feeder. Reference numerals 155 and 157 are paper feed rollers. Reference numeral 159 is a resist roller.

Reference numeral 161 is a conveying belt that conveys a recording paper that has recorded an image to a fixing section. Reference numeral 163 is a fixing unit that thermally fixes the image to the recording paper.

The front surface of the photosensitive drum 131 is coated with a photoconductor and a seamless photosensitive member made of a conductor. The drum 131 is rotatably pivoted. The photosensitive drum 131 is rotated in the direction of arrow of FIG. 6. The main motor 133 is activated according to the operation of a copy start key. After predetermined rotation control process and voltage control process (pre-processes) of the drum 131 are completed, the original document placed on the original document table glass 101 is illuminated by the lamp 103 incorporated with the first scanning mirror 105. The rays of light reflected from the original document are focused on the drum 131 through the first scanning mirror 105, the second scanning mirror 107, the third scanning mirror 109, the lens 111, and the fourth scanning mirror 113.

The drum 131 is corona charged by the primary charger 135. Thereafter, an image (original document image) illuminated by the lamp 103 is slit exposed an then a latent image is formed on the drum 131 by a known Carlson process.

Thereafter, the static latent image on the photosensitive drum 131 is developed by a developing roller 140 of the developing unit 139. Thus, a toner image is developed or visualized, and transferred to a transferring paper by the transferring charger 141.

In other words, a transferring paper in the upper cassette 151, the lower cassette 153, or the manual feeder 171 is conveyed to the inside of the image forming apparatus by the paper feed roller 155 or 157. The leading edge of the latent image is matched with the leading edge of the transferring paper.

Thereafter, the transferring paper is conveyed between the transferring charger 141 and the drum 131 and then unloaded to the outside of the image forming apparatus.

After the latent image is transferred to the transferring paper, the drum 131 is still rotated and the surface thereof is cleaned by the cleaning unit 145 that is constructed of a cleaning roller and an elastic blade.

Figure 7:
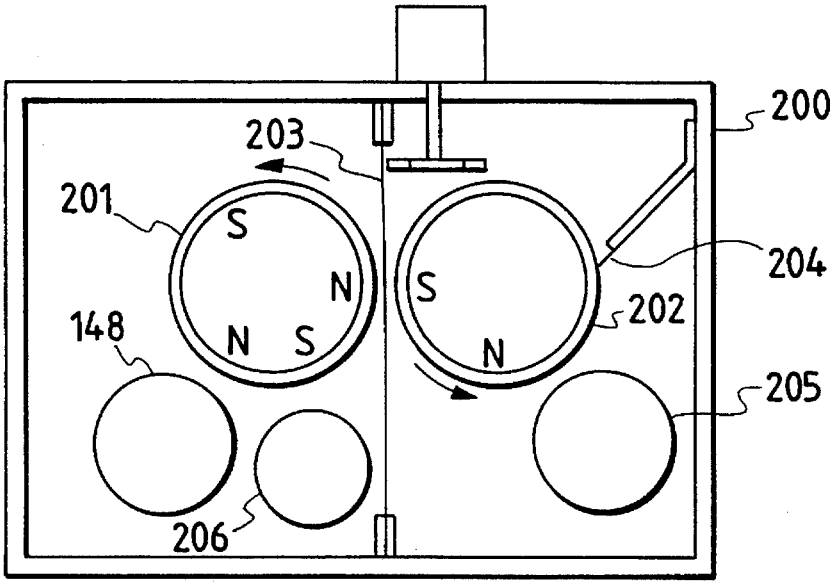
FIG. 7 is a sectional view showing a developing agent reproducing apparatus according to a third embodiment of the present invention.

The collected residue is conveyed by a conveying screw 148 and guided to a developing agent reproducing apparatus 200 shown in FIG. 7.

Reference numeral 148 is a screw that conveys the residue from the cleaning unit to the developing agent reproducing apparatus 200. The screw 148 conveys the residue from the rear side to front side shown in the drawing. Reference numeral 201 is a first magnetic field generating member that attracts a magnetic toner and foreign substances mixed with a magnetic toner by a magnetic force of a mixed magnet disposed in the sleeve. Thereafter, the sleeve is rotated in the direction of the arrow of the drawing and thereby these toner and foreign substances mixed therewith are conveyed to a position opposed to a second magnetic field generating member 202.

For example, the distance between the first and second sleeves is approximately 3 mm. The magnetic flux density of an N pole at an opposed position of the first sleeve is 750 Gauss. The magnetic flux density of an S pole at an opposed position of the second sleeve is 1000 Gauss.

A mesh filter 203 made of a non-magnetic material such as phosphor bronze is disposed at a nearly center position between the first and second sleeves and perpendicular to the installation plane of the image forming apparatus (namely, in parallel with the gravity working direction). The mesh density of the filter is preferably five to fifty times as large as the particle diameter of the toner (thus, the filter preferably is 200 to 300 mesh).

Figure 8:
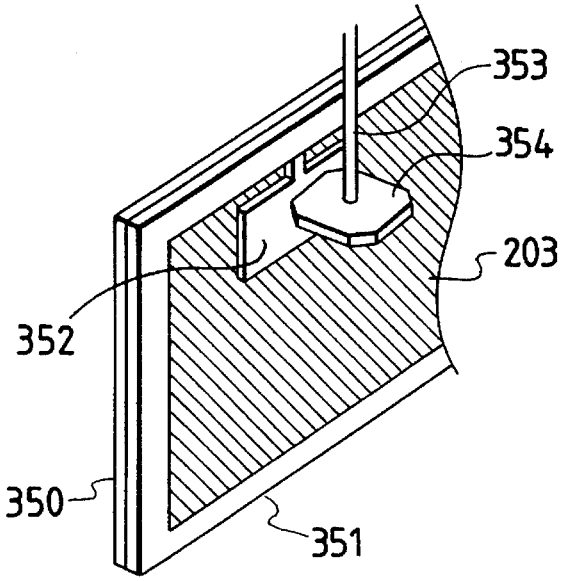
FIG. 8 is a perspective view showing a mesh filter vibrating unit.

The mesh filter can be vibrated. For example, as shown in FIG. 8, the mesh filter is disposed between frames 350 and 351. A leaf spring 352 is contacted to a part of the mesh filter. An elastic leaf cam 354 is connected to a rotating shaft 353 of a motor. As the leaf cam is rotated, the leaf spring is vibrated and thereby the mesh filter is vibrated.

The residue held on the first sleeve is attracted at an opposed position of the second sleeve by a magnetic field generated by the first and second sleeves. At this point, the magnetic field causes the magnetic toner contained in the residue to move from the first sleeve to the second sleeve. Thus, the magnetic toner, which moves from the first sleeve to the second sleeve, is held on the surface of the second sleeve through the mesh of the filter.

At this point, since part of paper powder contained in the residue is mixed with a toner, this paper powder tends to move from the first sleeve to the second sleeve. However, since the particle size of the paper powder is much larger than the particle size of the toner, the mesh of the filter prevents the paper powder from moving from the first sleeve to the second sleeve. Most toner, which is mixed with the paper powder and which causes the paper powder to move from the first sleeve toward the second sleeve, passes through the mesh of the filter. Thus, when the paper powder arrives at the mesh of the filter, it loses the moving force. In addition, the mesh of the filter is disposed between the first sleeve and the second sleeve nearly in parallel with gravity working direction. Thus, when the paper powder arrives at the mesh of the filter, it drops from the surface of the mesh by its dead weight. Consequently, the developing agent reproducing apparatus according to the third embodiment can separate the magnetic toner from foreign substances such as paper powder without occurrences of clogging of the mesh of the filter.

Figure 9:
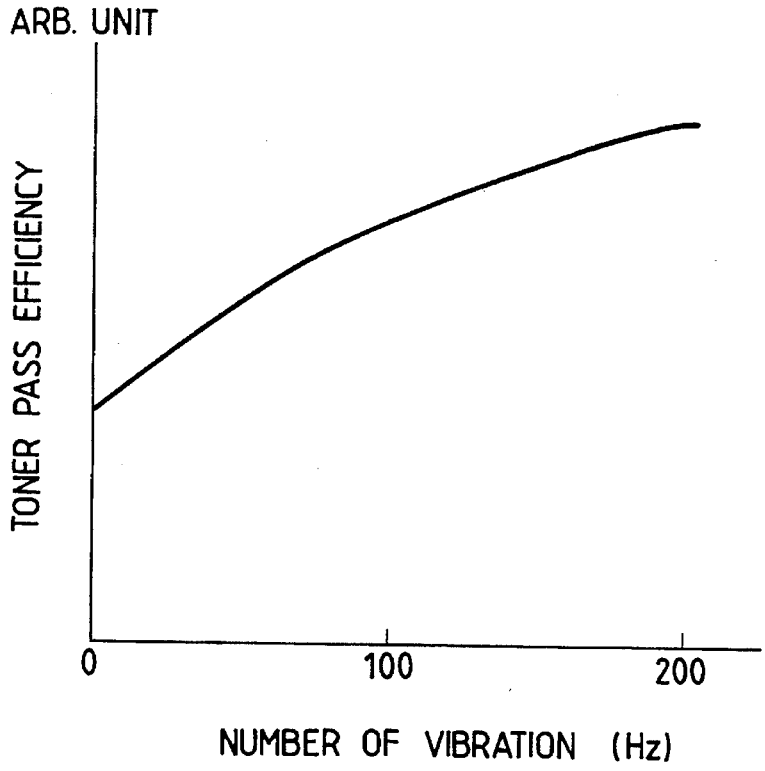
FIG. 9 is a graph for explaining vibrations and toner passing efficiency.

In this embodiment, the mesh of the filter is vibrated. Since the mesh filter is vibrated, aggregated toner in the vicinity of the mesh filter is loosened and thereby smoothly passes through the mesh filter. In addition, with vibrations, the paper powder tends to easily drop from the mesh filter. The paper powder that has dropped from the mesh filter is conveyed to a residue collecting portion by a screw 206. FIG. 9 shows the relation between vibrations and amount of toner that passes through the mesh filter per predetermined time unit (toner passing efficiency).

Figure 10:
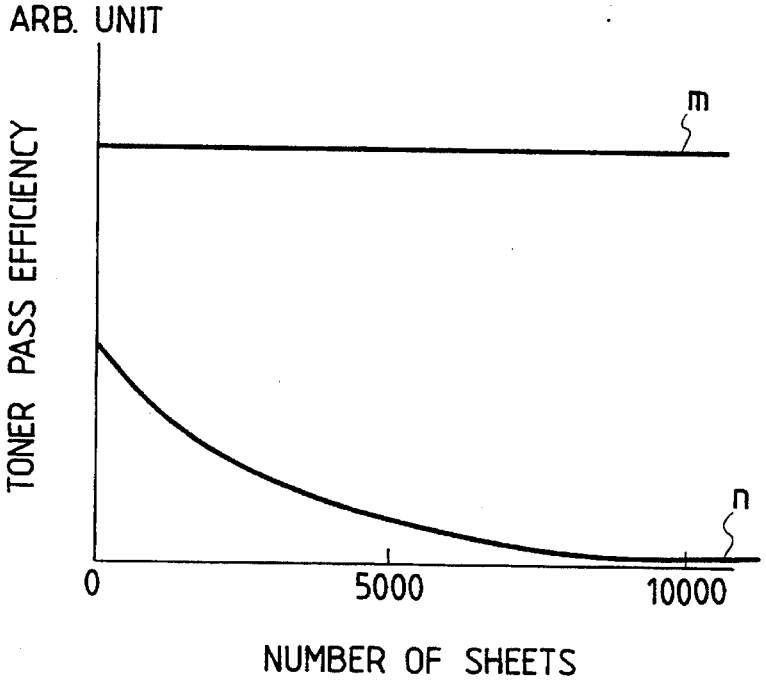
FIG. 10 is a graph for explaining variations of toner passing efficiency corresponding to the presence and absence of vibrations.

FIG. 10 shows the relation between the amount of toner that passes through the mesh filter per predetermined time unit (toner passing efficiency) and the number of papers copied both in the case that the mesh filter is vibrated at 100 Hz and in the case that the mesh filter is not vibrated. In FIG. 10, line m represents the case that the mesh filter is vibrated and line n represents the case that the mesh filter is not vibrated. As is clear from FIGS. 9 and 10, the vibrations allow the toner to smoothly pass through the mesh filter without occurrences of clogging thereof.

The toner that has moved to the second sleeve is conveyed to a scraper 204 as the second sleeve is rotated in the direction of the arrow of the drawing. The scraper 204 scrapes off the toner from the second sleeve. The scraped toner is conveyed to a developing agent hopper or a developing unit by a screw 205. In this manner, the toner is reused.

Figure 11:
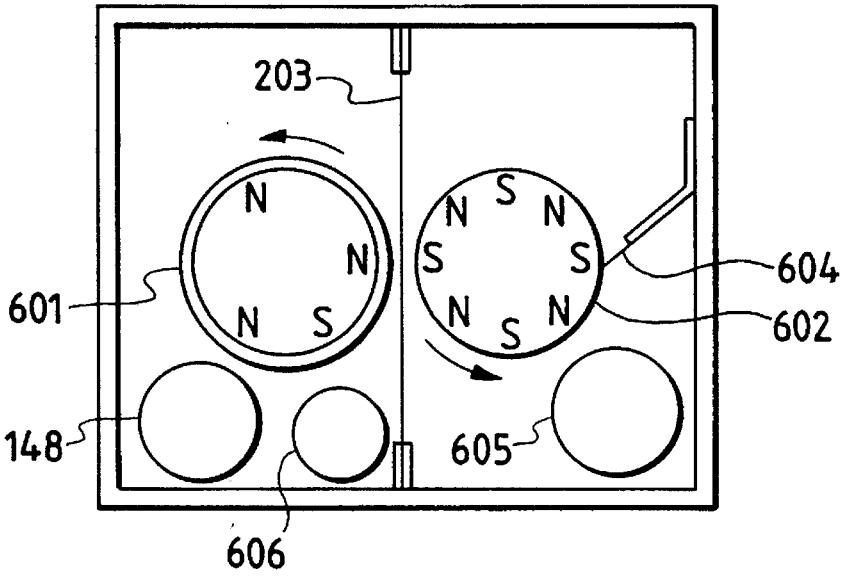
FIG. 11 is a sectional view schematically showing a developing agent reproducing apparatus according to a fourth embodiment of the present invention.

FIG. 11 shows a fourth embodiment of the present invention. In FIG. 11, reference numeral 148 is a screw that conveys residue collected from a cleaner to a developing agent reproducing unit. The collected toner is attracted to a sleeve 601 by for example an N pole of a magnet (as a magnetic field generating means) fixed in the sleeve 601. The sleeve 601 is rotated in the direction of the arrow of FIG. 11 so as to convey the collected toner. Reference numeral 203 is a non-magnetic mesh filter. Reference numeral 602 is a magnet roller with a plurality of magnetic poles (for example, eight magnetic poles). The magnet roller is rotated in the direction of the arrow of FIG. 11. When the magnetic poles of the opposed magnet sleeves 601 and 602 have a polarity opposite each other (in other words, when an N pole of the magnet sleeve 601 is opposed to an S pole of the magnet roller 602), the collected toner is attracted to the magnet roller 602. Thus, the toner passes through the mesh filter and then adheres to the magnet roller 602. As the magnet roller 602 is rotated, the same magnetic poles of the magnet sleeve 601 and the magnet roller 602 are opposed. Thereby, the toner is not (or is less) attracted to the magnet roller 602. Thus, collected toner is not present in the vicinity of the mesh filter. The effect of repetition of this process is similar to the effect of the vibrations of the mesh filter.

Non-magnetic residue does not pass through the mesh filter, but drops therefrom. This residue is conveyed to a residue collecting portion by a conveying screw 606 along the mesh filter.

On the other hand, the toner that adheres to the magnet roller 602 is conveyed to a scraper 604 in the reverse direction of the arrow shown in the drawing. The scraper 604 scrapes off the toner. The scraped toner is conveyed to a hopper or a developing unit by a conveying screw 605. In this manner, the toner is reused.

It should be noted that the rotating magnet roller may attract residue and cause it to move in the mesh direction and the sleeve may attract the toner through the mesh. The pair of magnetic field generating means may be formed of a pair of rotating magnet rollers.

Figure 12:
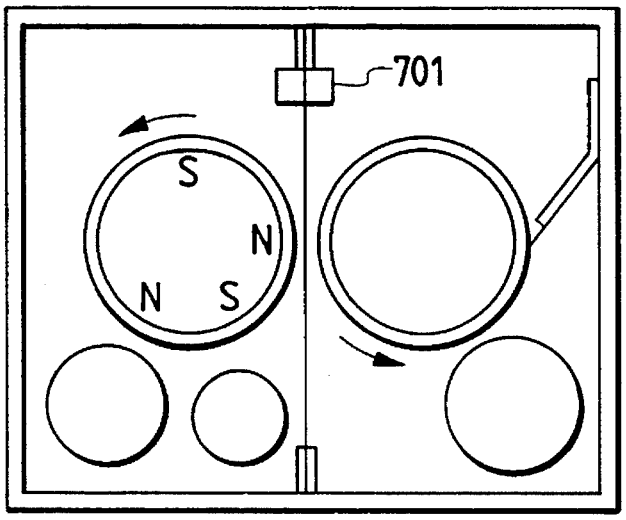
FIG. 12 is a sectional view showing a modification of the developing agent reproducing apparatus according to a fourth embodiment.

In the third embodiment, a mesh filter was vibrated by a rotating cam. However, as shown in FIG. 12, an ultrasonic vibrator may be disposed at the mesh filter so as to vibrate it.

Next, an embodiment where part of the foreign substances such as paper powder are removed by a first magnetic field generating means will be described.

Figure 13:
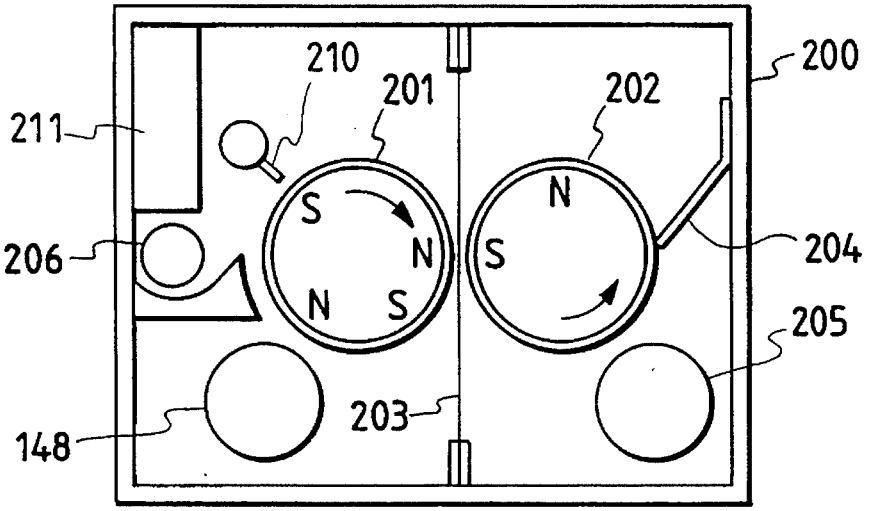
FIG. 13 is a sectional view schematically showing a developing agent reproducing apparatus according to a fifth embodiment of the present invention.

FIG. 13 shown a fifth embodiment of the present invention.

In FIG. 13, reference numeral 148 is a screw that conveys residue that has removed from the surface of a photosensitive member from the rear side to front side shown in the drawing. Reference numeral 201 is a first magnet sleeve. The collected toner is attracted by a magnetic force of a magnet disposed in the sleeve. Thereafter, the sleeve is rotated in the direction of the arrow shown in the drawing. The thickness of the collected toner is restricted to for example 300 μm by a blade 210. Thus, paper powder and the like are scraped off by the blade 210. In addition, the blade 210 limits the amount of collected toner to be conveyed to a position opposed to a second magnet sleeve 202. Thus, when a large amount of collected toner is conveyed to a mesh filter, it is clogged therewith. However, since the blade 210 limits the amount of toner, the mesh filter is prevented from being clogged with the toner.

The distance between the first and second sleeves is approximately 3 mm. The magnetic flux density of an N pole at an opposed position of the first sleeve is 750 Gauss. The magnetic flux density of an S pole at an opposed position of the second sleeve is 1000 Gauss.

A mesh filter 203 made of a non-magnetic material such as phosphor bronze is disposed at a nearly center position between the first and second sleeves. The mesh density of the filter is preferably five to fifty times as large as the particle diameter of the toner (thus, the mesh filter preferably is 200 to 300 mesh.

The mesh filter can be vibrated. For example, as in the first embodiment, the mesh filter is disposed between frames 350 and 351. A leaf spring 352 is contacted with a part of the mesh filter. An elastic leaf cam 354 is connected to a rotating shaft 353 of a motor. As the leaf cam is rotated, the leaf spring is vibrated and thereby the mesh filter is vibrated.

Figure 14:
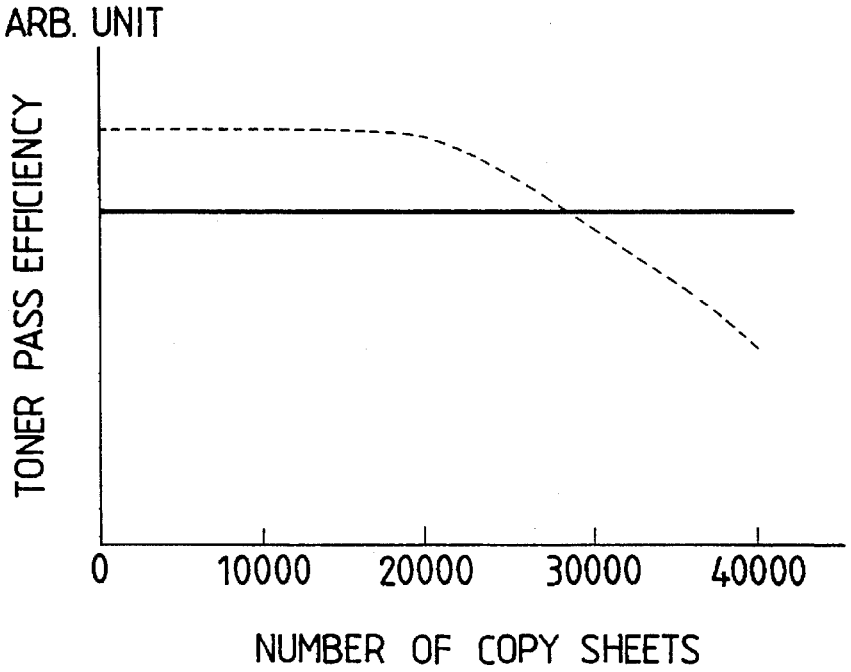
FIG. 14 is a graph for explaining variations of toner passing efficiency corresponding to the presence and absence of a blade.

The collected toner held on the first sleeve is attracted at a position opposed to the second sleeve. By a converged magnetic field of the second sleeve, part of the toner is attracted to the second sleeve through the mesh filter. When the mesh filter is vibrated, aggregated toner in the vicinity of the mesh filter becomes loose. Thus, the toner smoothly passes through the mesh filter. On the other hand, when the blade is rotated, paper powder and the like collected by the blade portion are scraped off by a cleaning member such as felt 211. The scraped substances drop to a conveying screw 206. The conveying screw 206 conveys the substances to a residue collecting portion. FIG. 14 shows the relation between the number of papers copied and the amount of toner that passes through the mesh filter per predetermined time unit (toner passing efficiency) both in the case that the blade is used and in the case that the blade is not used. The case that the blade is used is represented by a solid line. The case that the blade is not used is represented by a dotted line. As is clear from FIG. 14, in the case that the blade is used, after a large number of papers have been copied, toner effectively and stably passes through the mesh filter.

The toner that has passed through the mesh filter is conveyed to a scraper 204 as the second sleeve is rotated in the direction of the arrow shown in the drawing. The scraper 204 scrapes off the toner from the second sleeve. The toner scraped off is conveyed to a developing agent hopper or a developing unit by a screw 205. In this manner, the toner is reused.

Figure 15:
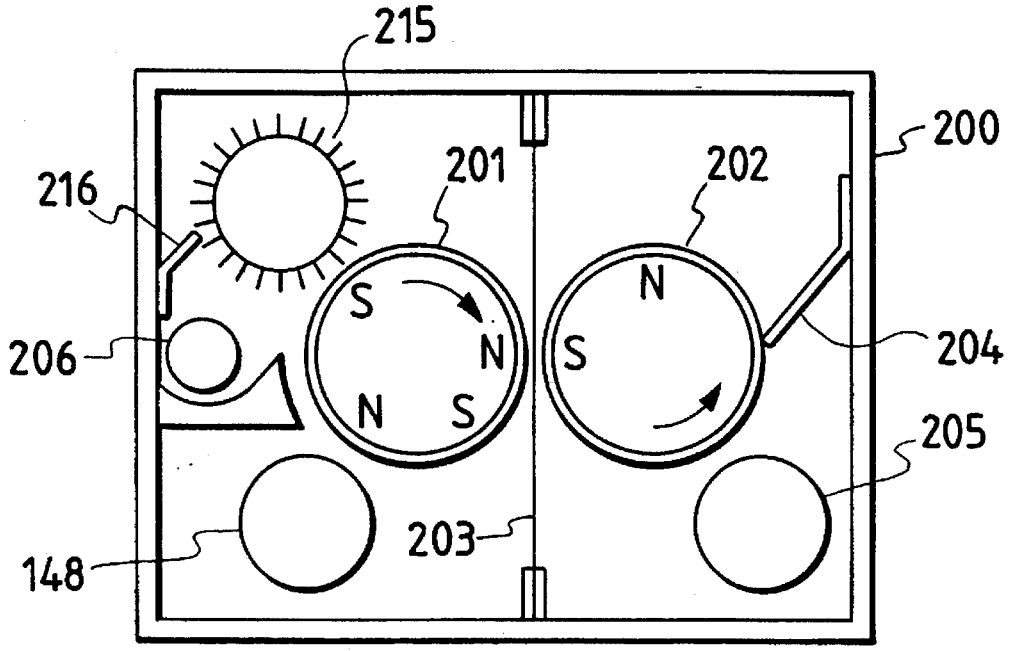
FIG. 15 is a sectional view schematically showing a developing agent reproducing apparatus according to a sixth embodiment of the present invention.

FIG. 15 shows a sixth embodiment of the present invention. In the sixth embodiment, as in the above-described embodiment, residue is attracted to a first magnet sleeve. Thereafter, the sleeve is rotated in the direction of the arrow shown in FIG. 15. Reference numeral 215 is a brush roll that is spaced apart from the sleeve by around 0.5 mm and is rotated in the counterclockwise direction. The brush collects paper powder and the like. In addition, the brush roll limits the amount of toner conveyed to a position opposed to a second magnet sleeve 202. Thus, a large amount of toner is not conveyed to a mesh filter portion, thereby preventing the filter from being clogged with the toner. Thereafter, as in the third embodiment, the toner that has passed through the mesh filter is reused. On the other hand, paper powder and the like that have been collected by the brush roll is removed by an elastic plate 216. Thus, these substances drop downward to a conveying screw 206. The conveying screw 206 conveys these substances to a residue collecting portion. When a roller is used instead of the brush roll, although the efficiency of removing paper dust and the like is degraded, a similar effect can be obtained.

Figure 16:
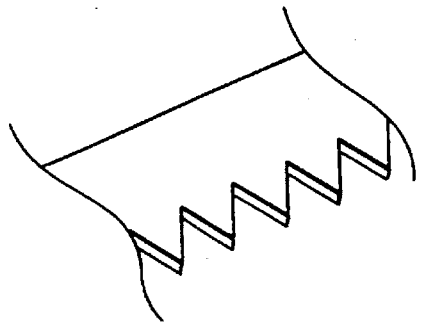
FIG. 16 is an enlarged perspective view showing a residue layer restricting blade for use in a developing agent reproducing apparatus according to a seventh embodiment of the present invention.

In a seventh embodiment, the thickness of collected toner layer is restricted with a blade in the same construction as the fifth embodiment. As shown in FIG. 16, since the edge portion of the blade is formed in a saw shape, the efficiency of removing paper powder is improved. In addition, this construction can prevent the blade portion from being clogged with paper powder and the like. Thus, the collected toner can be stably conveyed to a mesh filter portion.

The mesh filter is vertically disposed. The magnetic force generating means causes the toner to horizontally pass through the mesh filter. In addition, the mesh filter is vibrated. Thus, aggregated toner in the vicinity of the mesh filter can become loose. The thickness of toner layer in the mesh filter portion is restricted. Moreover, paper powder and the like are pre-treated. Thus, the efficiency for passing the toner to the mesh filter is improved. Moreover, even if a large amount of toner is collected, it can be effectively reused.

As is clear from the first to seventh embodiments, the installation angle $\alpha$ of the filter should be in the range from 0°, which is an angle parallel with the installation plane of the image forming apparatus as with the first and second embodiments, to 90°, which is an angle perpendicular to the installation plane thereof as with the third to seventh embodiments. In other words, when the angle to a plane perpendicular to the gravity working direction is $\alpha=0°$, the installation angle of the filter should be in the range of $0° \leqq \alpha \leqq 90°$.

As described in the first to seventh embodiments, when an attracting member is disposed upstream of the filter in the gravity working direction, clogging of the filter can be prevented, and thereby the maintenance sessions of the apparatus can be reduced.

In the following embodiment, while an image forming apparatus is stopped, a mesh filter can be prevented from being clogged. Next, an eighth embodiment of the present invention will be described. For simplicity, the same element as the above-described embodiments are denoted by the same reference numerals.

In a developing agent reproducing apparatus according to the eighth embodiment, relative positions of magnetic poles of sleeves 18 and 19 that are opposed with a mesh 20 therebetween so as to prevent the mesh 20 from being clogged while a copy operation is stopped or the power of the image forming apparatus is turned off.

Next, with reference to FIGS. 2, 17, and 18, the eighth embodiment of the present invention will be described.

Shaft ends 19*a* and 20*a* that are rotatably connected to the sleeves 18 and 19 protrude from a frame 17*a* of a developing agent reproducing apparatus 17. The shaft ends 19*a* and 20*a* are formed in a D cut shape. The D cut shaped shaft ends 19*a* and 20*a* are connected to respective ends of magnetic pole aligning plates 31 and 32, respectively. The other end of the magnetic pole aligning plate 31 is fixed to the frame 17*a* with a machine screw. While the developing agent reproducing apparatus is separating a toner from paper powder, the magnetic pole position of the magnet disposed in the sleeve 19 is fixed as shown in FIG. 2. The other end of the magnetic pole aligning plate 32 connected to a shaft fixed to a magnet 18' is connected to a shaft 33. The shaft 33 is fit to an oval hole 35 defined at one end of a lever 34. The lever 34 has a rotating fulcrum 36 fixed to the frame 17*a*. The other end of the lever 34 is fit to an iron core 39 of a solenoid 38 with a pin 37. One end of a resilient spring 40 is hooked in the vicinity of the oval hole 35 at one end of the lever 34. The other end of the resilient spring 40 is hooked to a bend portion 42 of a solenoid support table 41. Thus, the magnet disposed in the sleeve 18 is resiliently rotated in the counterclockwise direction by the resilient force of the resilient spring 40. In addition, the magnet of the sleeve 18 that is resiliently rotated is contacted with a bend portion 43 of the solenoid support table 41. Thus, the magnetic pole position is fixed. The rotations of the sleeves 18 and 19 are transferred by a drive source (not shown) through gears and the like.

Thus, in the developing agent reproducing apparatus according to the eighth embodiment, regardless of whether or not a copy operation is being performed, the magnet 19' is always oriented in the same direction. In other words, as shown in FIG. 2, an N pole of the magnet 19' is always opposed to the mesh 20.

On the other hand, a magnetic pole of the magnet 18' that is opposed to the mesh 20 is changed depending on whether or not the copy operation is being performed.

Figure 17:
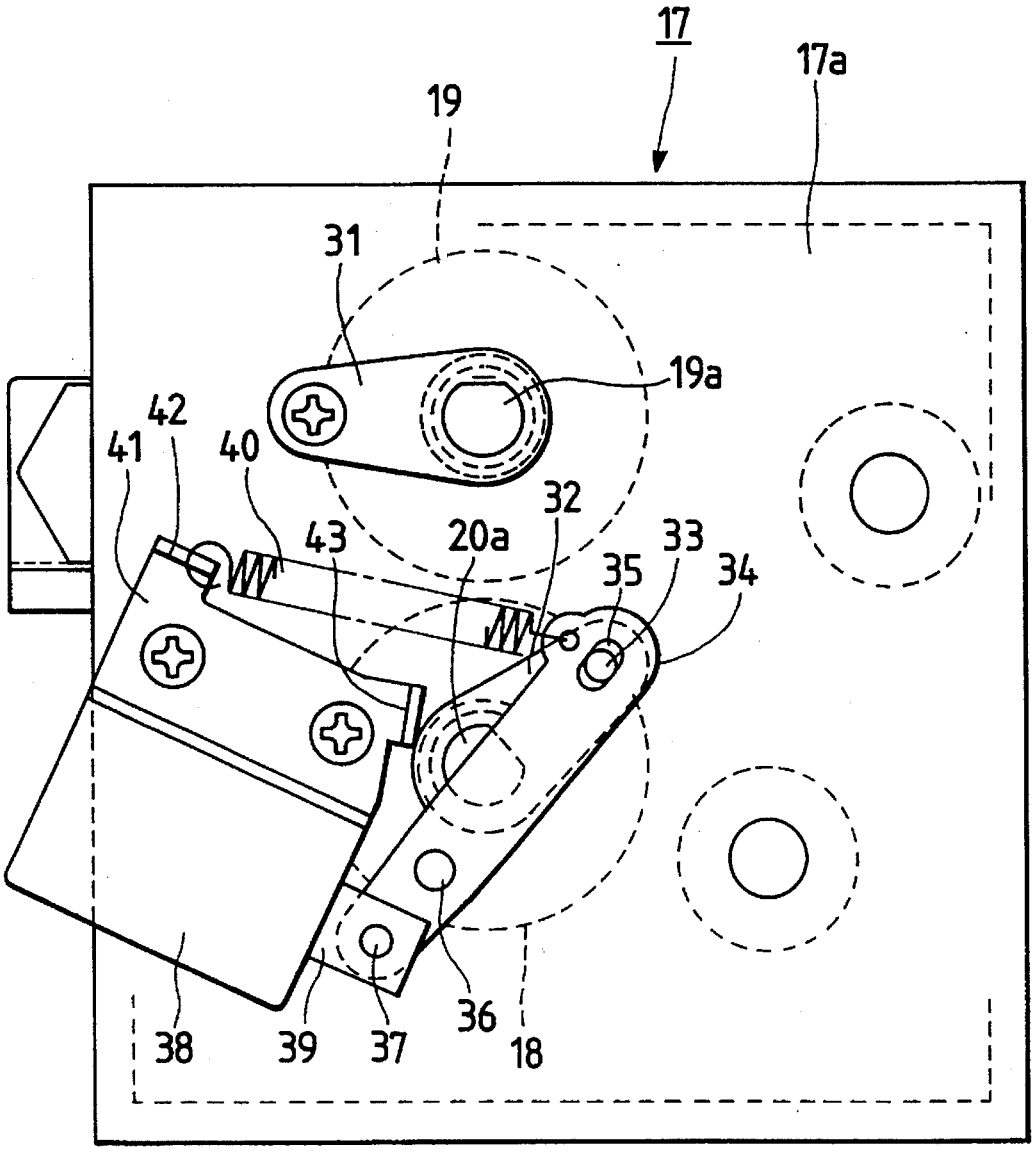
FIG. 17 is a sectional view showing a construction of a magnetic pole position changing mechanism for use in a developing agent reproducing apparatus according to an eighth embodiment of the present invention.

In other words, as shown in FIG. 17, while the copy operation is being performed, the solenoid 38 is energized and thereby the iron core 39 is attracted. Thus, the magnetic pole position of the magnet disposed in the sleeve 18 is fixed in a developing agent reproducing position as shown in FIG. 2. The solenoid 38 is adjustably mounted on the support table 41 so that the magnetic pole position of the magnet 18' is precisely set when the iron core 39 is attracted.

Figure 18:
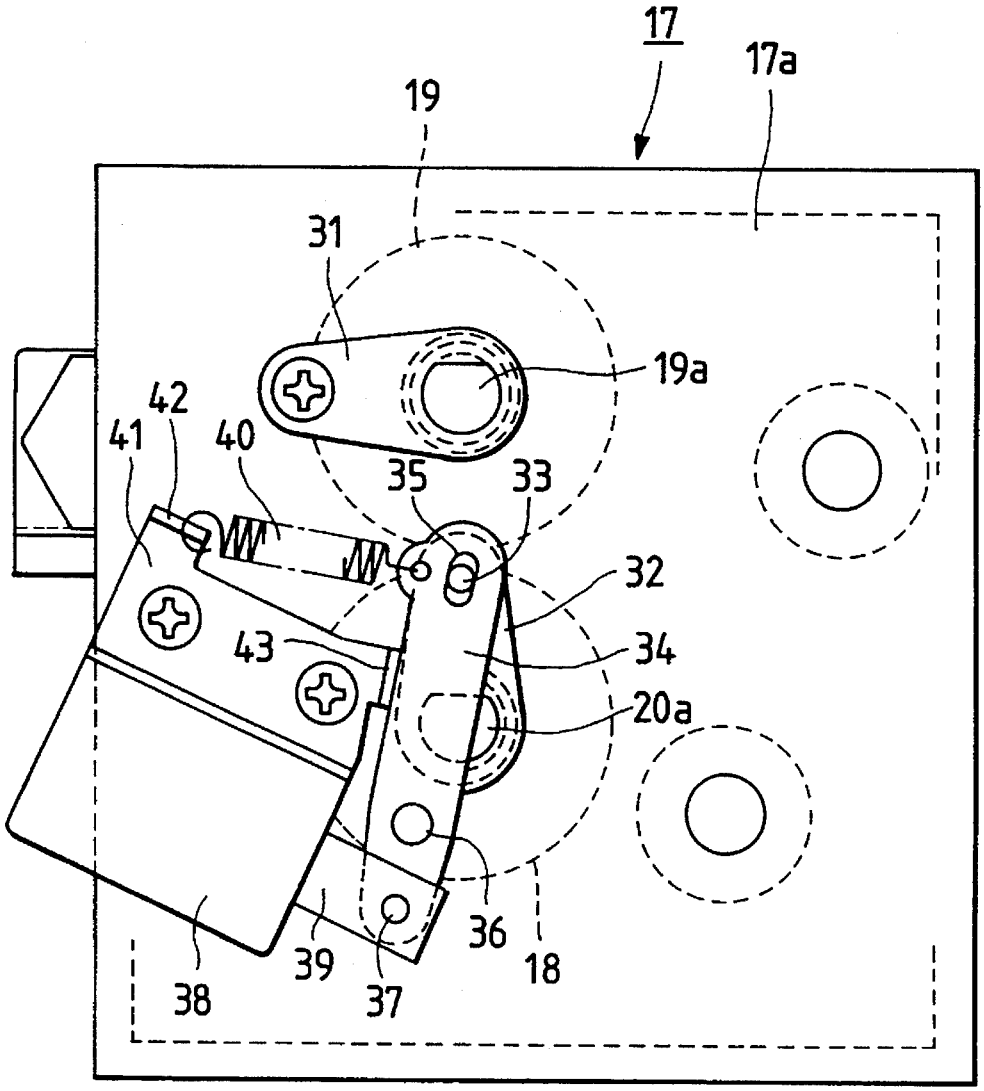
FIG. 18 is a sectional view showing a construction of a magnetic pole position changing mechanism for use in the developing agent reproducing apparatus according to the eighth embodiment of the present invention.

As shown in FIG. 18, after the copy operation is completed, the solenoid 38 is deenergized and the lever 34 is rotated in the counterclockwise direction by the resilient force of the resilient spring 40. In addition, the magnetic pole aligning plate 32 is rotated in this direction and thereby the lever 34 is contacted to the bend portion 43 of the solenoid support table 41 at a position where a magnetic pole N18 of the magnet 18' is opposed to a magnetic pole N19 of the magnet of the sleeve 19. Thus, the magnetic pole position of the magnet 18 is fixed. In other words, while the copy operation is not being performed, the magnetic poles N18 and N19 are opposed with the mesh 20. Thus, magnetic toner does not move from the magnetic pole N18 to the magnetic pole N19.

With the above-described construction and operation, while the copy operation is stopped or the main switch of the image forming apparatus is turned off, developing agent in the vicinity of the sleeves 18 and 19 can be prevented from being aggregated.

In the eighth embodiment, when the solenoid 38 was deenergized, the magnet was rotated in the same direction as the sleeve 18. However, it should be noted that the rotating direction of the magnet may be opposite that of the sleeve 18. In this case, while the copy operation is stopped, foreign substances such as paper powder (other than developing agent) that are present between the doctor blade 25 and the sleeve 18 are removed. Since the thickness of the developing agent on the surface of the sleeve 18 is not changed, the conveying force of the developing agent to the mesh portion 20 is not reduced.

In the eighth embodiment, it should be appreciated that the magnet disposed in the sleeve 19 may be rotated instead of the magnet 18' disposed in the sleeve 18.

Figure 19:
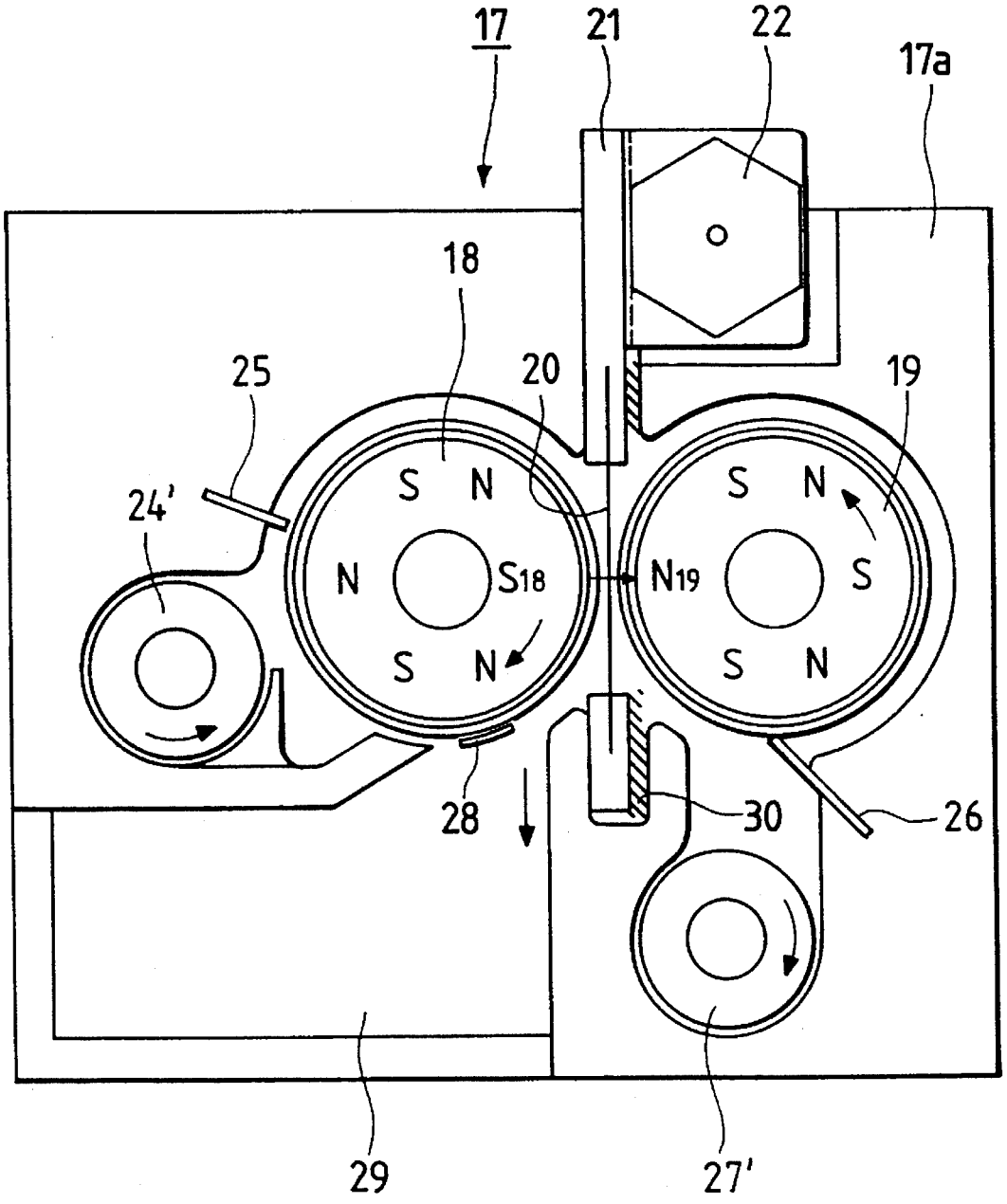
FIG. 19 is a sectional view showing a construction of the developing agent reproducing apparatus according to the eighth embodiment of the present invention.

As shown in FIG. 19, the present invention may be applied to a developing agent separating apparatus where the mesh 20 that serves as a mesh filter is vertically disposed and sleeves 18 and 19 with respective magnets that serve as magnetic field generating means are disposed at opposed positions with the mesh 20 therebetween.

Figure 20:
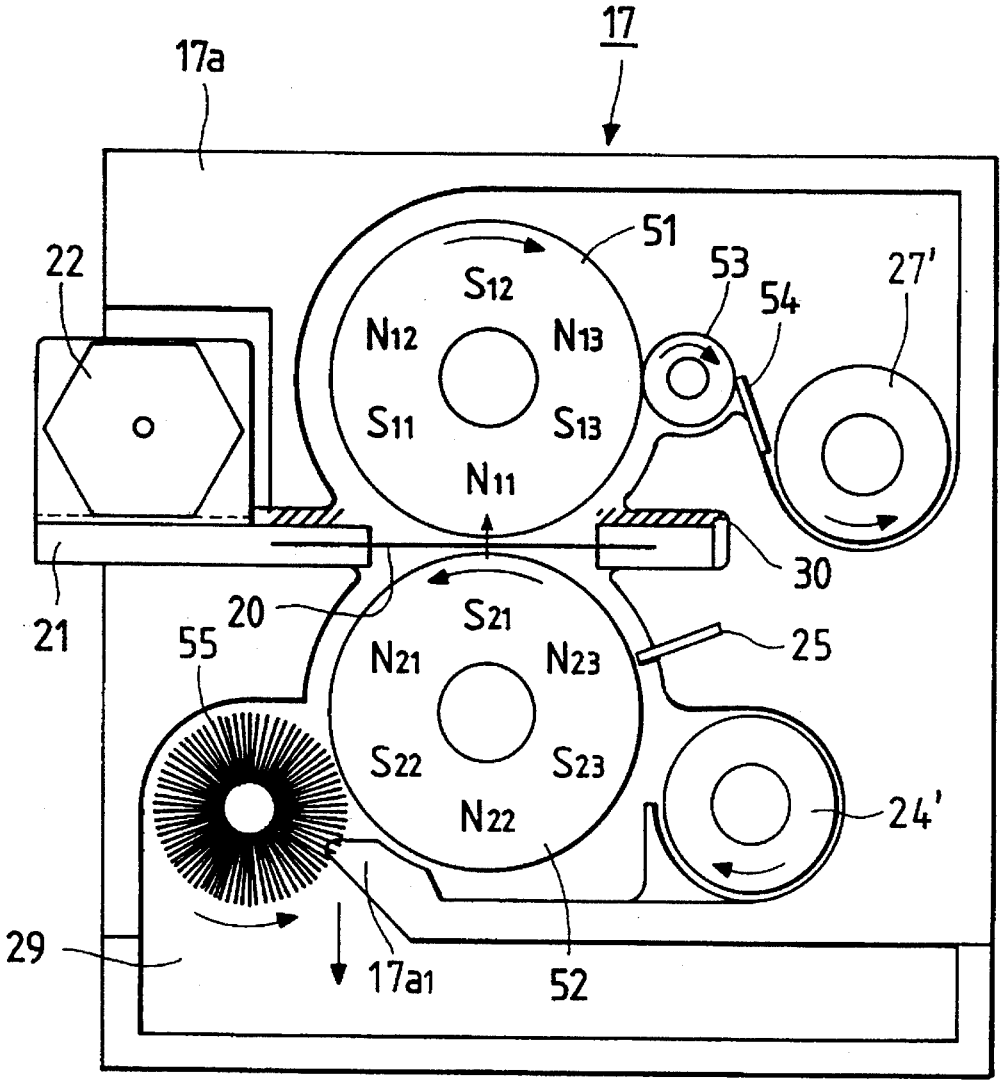
FIG. 20 is a sectional view showing a construction of a developing agent reproducing apparatus according to a ninth embodiment of the present invention.

Next, with reference to FIG. 20, a ninth embodiment of the present invention will be described. FIG. 20 is a sectional view showing a construction of a separating apparatus according to the ninth embodiment of the present invention. For simplicity, the same elements as in the above-described embodiments are denoted by the same reference numerals.

In FIG. 20, reference numerals 51 and 52 are magnet rollers that serve as magnetic force generating means and that are disposed at opposed positions of a separating portion so that the magnetic poles of the opposed magnet rollers have opposite polarity. The magnet poles (N11 and S11) of the magnet roller 51 and the magnet poles (N21 and S21) of the magnet roller 52 have the relation of N11>S21 and S11>N21. The magnet poles are disposed at predetermined angles. The magnet rollers 51 and 52 are rotated at the same speed by a drive source (that will be described later) so that the magnetic poles of the opposed magnet rollers at the separating portion have opposite polarity.

Next, the operation of the developing agent reproducing apparatus will be described. A developing agent held on the magnet roller 52 is scraped off by a doctor blade 25 so as to restrict the thickness of the developing agent layer on the magnet roller 52. The developing agent held on the magnet roller 52 is conveyed to the separating portion. At the separating portion, the developing agent is effectively attracted by converged magnetic lines of force. Since the magnetic force of the magnetic poles N11 and S11 of the upper magnet roller 51 is larger than that of the magnetic poles N21 and S21 of the lower magnet roller 52, the developing agent is strongly attracted to the magnetic poles N11 and S11 and moved upward through a mesh 20. The developing agent is separated from the foreign substances by the mesh 20.

The magnet roller 51 is contacted to a scrap-off roller 53 made of a magnetic material and is rotated. The developing agent that has been separated is temporarily attracted and transferred to the scrape-off roller 53. The developing agent then is scraped off by a scrape-off blade 54 contacted to the scrape-off roller 53. The developing agent separated from the foreign substances is conveyed by a conveying screw 27' to the outside of the developing agent reproducing apparatus 17. The residual foreign substances and residual developing agent are conveyed to a downstream section by the magnet roller 52. Foreign substances are collected by a cleaning brush 55 made of a non-magnetic material. The foreign substances are scraped off by a protruding portion **17*a1* to a collecting portion 29. Since the residual developing agent has a magnetic force, it is still attracted by the magnet roller 52. Thus, the residual developing agent is conveyed to the downstream section, rather than being collected by the cleaning brush 55. Thus, the developing agent separating operation is performed for the residual developing agent. Consequently, most of developing agent is not collected in the collecting portion. Only foreign substances made of non-magnetic materials are collected in the collecting portion 29**.

Figure 21:
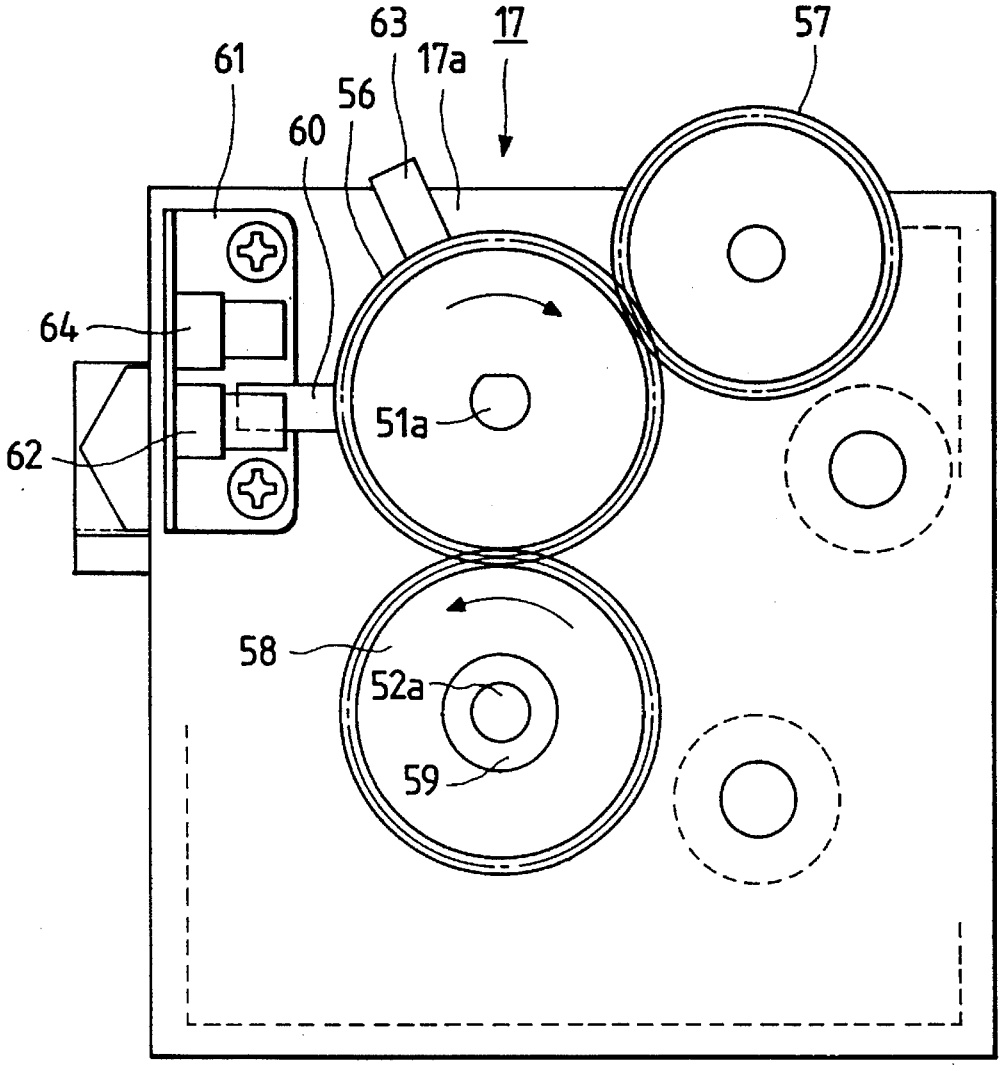
FIG. 21 is a sectional view showing a construction of a magnetic pole position changing mechanism according to the ninth embodiment of the present invention.
Figure 22:
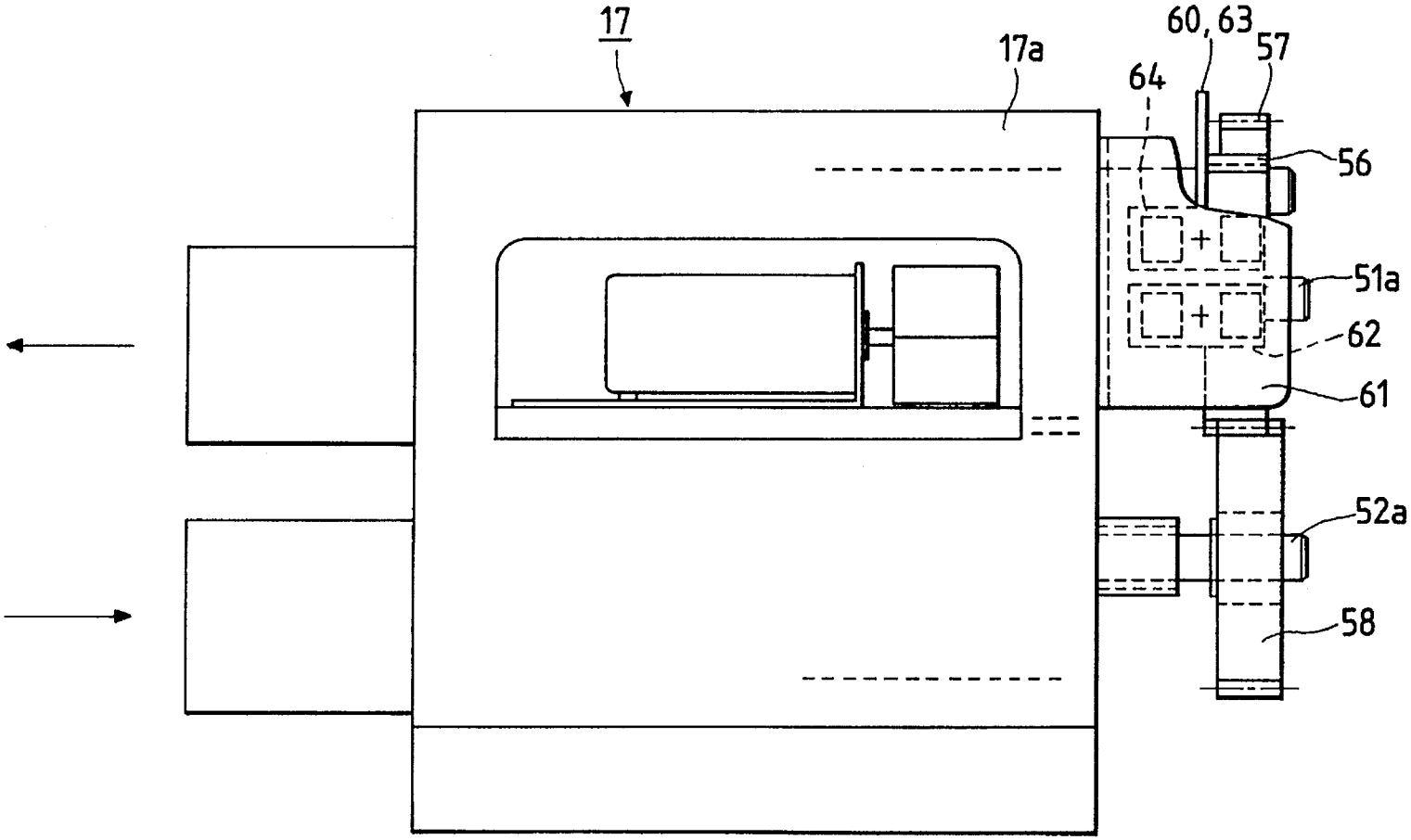
FIG. 22 is a sectional view showing a construction of a magnetic pole position changing mechanism according to the ninth embodiment of the present invention.
Figure 23:
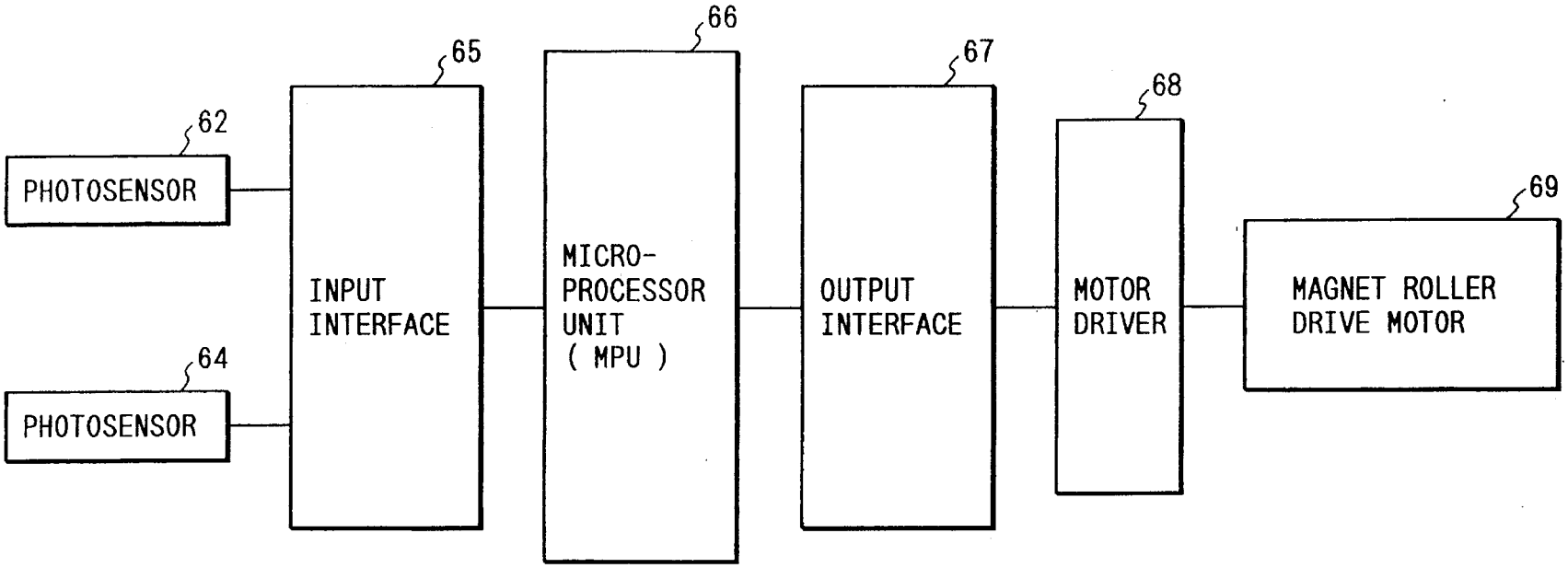
FIG. 23 is a block diagram showing a control system according to the ninth embodiment of the present invention.

The developing agent reproducing apparatus 17 has a construction where the relative positions of magnetic poles of the magnet rollers 51 and 52 opposed with the mesh 20 therebetween can be changed so as to prevent the mesh 20 from being clogged when the copy operation is stopped or the power of the image forming apparatus is turned off. This construction will be described with reference to FIGS. 21 to 23. FIGS. 21 and 22 are sectional views showing the construction of a magnetic pole position changing mechanism. FIG. 23 is a block diagram showing a control system of the developing agent reproducing apparatus.

A gear 56 is engaged with a shaft and **51*a* of a magnet roller 51 outside a frame 17*a* of the developing agent reproducing apparatus 17. The magnet roller 51 is rotated by a drive source (not shown) through a gear 57 rotatably connected on the frame 17*a*. A gear 58 that is engaged with the gear 56 is disposed at a shaft end 52*a* of the magnet roller 52. A one-way clutch 59 is disposed between the shaft end 52*a* of the magnet roller 52 and the gear 58. The one-way clutch 59 limits the rotating direction in one way. With the one-way clutch 59, when the developing agent reproducing apparatus is operated, in the case that the gear 58 is rotated in the direction of the arrow shown in the drawing, the magnet roller 52 is rotated in the same direction. Since the magnet rollers 51 and 52 should be rotated in phase so that the magnetic poles at the opposed positions of the magnet rollers 51 and 52 always have an opposite polarity, the number of teeth of the gear 56 is the same as that of the gear 58. To assemble or disassemble the magnet rollers 51, and 52 and the gears 56 and 58 for repair or maintenance, magnetic pole aligning marks may be placed on the magnet rollers 51 and 52** for initial phase adjustment.

While the copy operation is being performed, the magnet rollers 51 and 52 are rotated in the respective directions of the arrows shown in the drawing so as to separate an image forming agent from foreign substances such as paper powder. After the copy operation is completed, the magnet rollers 51 and 52 are rotated in these directions by the respective drive shafts. When a flag 60 fixed on a side surface of the drive gear 56 blocks a photo sensor 62 disposed on the frame **17*a* of the developing agent reproducing apparatus 17 through a support plate 61, a signal that is output from the photo sensor 62 causes the rotations of the magnet rollers 51 and 52 to stop so that the magnet pole N11 and the magnet pole S21 are opposed at the separating portion (see FIG. 20**).

Thereafter, a microprocessor unit (MPU) that controls the developing agent reproducing apparatus causes the drive source to rotate the magnet rollers 51 and 52 in the reverse directions of the arrows shown in the drawing. When a flag 63 disposed on a side surface of the drive gear 56 blocks a photo sensor 64 disposed through the support plate 61, a signal that is output from the photo sensor 64 causes the magnet rollers 51 and 52 to stop.

Since the one-way clutch 59 is disposed between the magnet roller 52 and the gear 58, while the gear is rotated in the reverse direction of the arrow shown in the drawing, the magnet roller 52 is not rotated. Thus, when the flag 63 blocks the photo sensor 64, the magnet roller 51 is stopped so that the magnetic pole S11 thereof and the magnetic pole S21 of the magnet roller 52 are opposed at the separating portion.

As shown in FIG. 23, the control system controls the developing agent reproducing apparatus as follows. When signals that are output from the photosensors 62 and 64 are sent to the microprocessor unit (MPU) 66 through an interface 65, a motor driver 68 is driven through an output interface 67 corresponding to the signals so as to drive a drive motor 69 that rotates the magnet rollers.

In the developing agent reproducing apparatus according to the ninth embodiment, when the same magnetic poles of the magnet rollers 51 and 52 are opposed at the separating portion, the magnet rollers 51 and 52 are rotated by their repelling forces. To prevent the opposed magnetic poles from being moved, a weak current may be supplied to a motor that is the drive source of the magnet rollers 51 and 52. With the holding force of the motor, the magnet rollers 51 and 52 may be prevented from being rotated.

Unlike with the driving and transferring mechanism of the above-described developing agent reproducing apparatus, the one-way clutch 59 may be disposed between the magnet roller 51 and the gear 56.

Although the present invention has been shown and described with respect to best mode embodiments thereof, it should be understood by those skilled in the art that the foregoing and various other changes, omissions, and additions in the form and detail thereof may be made therein without departing from the spirit and scope of the present invention.

What is claimed is:

1. A developing agent recovery apparatus, comprising:

recovery means for recovering a magnetic toner from a mixture of said magnetic toner and foreign substances, said recovery means having magnetic force generating means for generating a magnetic force to attract the magnetic toner, and a filter for preventing substances other than said magnetic toner of said mixture from passing therethrough, said filter being disposed in a region in which said magnetic toner is moved by said magnetic force generating means, wherein said magnetic force generating means is disposed upstream of said filter in a gravity working direction.

2. The developing agent recovery apparatus as set forth in claim 1, wherein said magnetic force generating means comprises a first magnetic field generating member for generating a magnetic field and is adapted to attract said magnetic toner.

3. the developing agent recovery apparatus as set forth in claim 2, further comprising:

a second magnetic field generating member disposed downstream of said filter in said gravity working direction, wherein said mixture is attracted to said second magnetic field generating member, moved to a position opposed to said first magnetic field generating member, and attracted toward said first magnetic field generating member.

4. The developing agent recovery apparatus as set forth in claim 3, wherein said first magnet field generating member and said second magnetic field generating member are disposed so that opposite magnetic poles are opposed and that the magnetic flux density of said first magnetic field generating member is larger than the magnetic flux density of said second magnetic field generating member.

5. The developing agent recovery apparatus as set forth in claim 1, wherein said filter has a mesh.

6. The developing agent recovery apparatus as set forth in claim 5, wherein the density of said mesh is in the range from #400 to #100.

7. The developing agent recovery apparatus as set forth in claim 1, wherein said filter has a plane surface an installation angle $\propto$ that satisfies the relation $0° \leqq \propto \leqq 90°$ wherein an angle perpendicular to a gravity working direction is $\propto = 0$.

8. An image forming apparatus for forming an image on a recording member, comprising:

an image carrier;

image forming means for forming an image on said image carrier;

cleaning means for removing a residue from said image carrier after an image has been transferred to said recording member; and recovery means for recovering magnetic toner from residue removed from said image carrier, said recovery means having magnetic force generating means for generating a magnetic force to attract the magnetic toner, and a filter for preventing substances other than said magnetic toner of said residue from passing therethrough, said filter being disposed in a region where said magnetic toner is moved by said magnetic field generating means, wherein said magnetic field generating means is disposed upstream of said filter in a gravity working direction.

9. The image forming apparatus as set forth in claim 8, wherein said magnetic field generating means comprises a first magnetic field generating member for generating a magnetic field and is adapted to attract said magnetic toner.

10. The image forming apparatus as set forth in claim 9, further comprising:

a second magnetic field generating member disposed downstream of said filter in said gravity working direction, wherein said mixture is attracted to said second magnetic field generating member, moved to a position opposed to said first magnetic field generating member, and attracted toward said first magnetic field generating member.

11. The image forming apparatus as set forth in claim 10, wherein said first magnetic field generating member and said second magnetic field generating member are disposed so that opposite magnetic poles are opposed and that the magnetic flux density of said first magnetic field generating member is larger than the magnetic flux density of said second magnetic field generating member.

12. The image forming apparatus as set forth in claim 8, wherein said filter has a mesh.

13. The image forming apparatus as set forth in claim 12, wherein the density of said mesh is in the range from #400 to #100.

14. The image forming apparatus as set forth in claim 8, wherein said filter has a plane surface and an installation angle $\propto$ that satisfies the relation $0° \leqq \propto \leqq 90°$ where an angle perpendicular to a gravity working direction is $\propto = 0$.

15. A developing agent recovery apparatus, comprising:

recovery means for recovering a developing agent from a mixture of said developing agent and foreign substances, said recovery means having an attracting member for attracting said developing agent, and a filter for preventing substances other than said developing agent of said mixture from passing therethrough, said filter being disposed in a region in which said developing agent is moved by said attracting member, wherein said attracting member is disposed upstream of said filter in a gravity working direction, and said filter includes a mesh having a density in the range of #400 to #100.

16. A developing agent recovery apparatus, comprising:

recovery means for recovering a developing agent from a mixture of said developing agent and foreign substances, said recovery means having an attracting member for attracting said developing agent, and a filter for preventing substances other than said developing agent of said mixture from passing therethrough, said filter being disposed in a region in which said developing agent is moved by said attracting member, wherein said attracting member is disposed upstream of said filter in a gravity working direction, has a first magnetic field generating member for generating a magnetic field, and is adapted to attract a magnetic toner used as said developing agent, and a second magnetic field generating member disposed downstream of said filter in said gravity working direction, wherein said mixture is attracted to said second magnetic field generating member, moved to a position opposed to said first magnetic field generating member, and attracted toward said first magnetic field generating member.

17. The developing agent recovery apparatus as set forth in claim 16, wherein said first magnetic field generating member and said second magnetic field generating member are disposed so that opposite magnetic poles are opposed and that the magnetic flux density of said first magnetic field generating member is larger than the magnetic flux density of said second magnetic field generating member.

18. An image forming apparatus for forming an image on a recording member, comprising:

an image carrier;

image forming means for forming an image on said image carrier;

cleaning means for removing a residue from said image carrier after an image has been transferred to said recording member; and recovery means for recovering developing agent from residue removed from said image carrier, said recovery means having an attracting member for attracting said developing agent and a filter for preventing substances other than said developing agent of said residue from passing therethrough, said filter being disposed in a region where said developing agent is moved by said attracting member, wherein said attracting member is disposed upstream of said filter in a gravity working direction, and said filter includes a mesh having a density in the range of #400 to #100.

19. The image forming apparatus as set forth in claim 18, wherein said filter has a plane surface and an installation angle $\propto$ that satisfies the relation $0° \leqq \propto \leqq 90°$ where an angle perpendicular to a gravity working direction is $\propto = 0$.

20. An image forming apparatus for forming an image on a recording member, comprising:

an image carrier;

image forming mens for forming an image on said image carrier;

cleaning means for removing a residue from said image carrier after an image has been transferred to said recording member; and recovery means for recovering developing agent from residue removed from said image carrier, said recovery means having an attracting member for attracting said developing agent and a filter for preventing substances other than said developing agent of said residue from passing therethrough, said filter being disposed in a region where said developing agent is moved by said attracting member, wherein said attracting member is disposed upstream of said filter in a gravity working direction, has a first magnetic field generating member for generating a magnetic field, and is adapted to attract a magnetic toner as said developing agent, and a second magnetic field generating member disposed downstream of said filter in said gravity working direction, wherein magnetic toner is attracted to said second magnetic field generating member, moved to a position opposed to said first magnetic field generating member, and attracted toward said first magnetic field generating member, and wherein said first magnetic field generating member and said second magnetic field generating member are disposed so that opposite magnetic poles are opposed and that the magnetic flux density of said first magnetic field generating member is larger than the magnetic flux density of said second magnetic field generating member.

* * * * *

UNITED STATES PATENT AND TRADEMARK OFFICE

CERTIFICATE OF CORRECTION

PATENT NO. : 5,486,905

DATED : January 23, 1996

INVENTOR(S) : ATSUSHI TAKEDA, et al.

It is certified that error appears in the above-indentified patent and that said Letters Patent is hereby corrected as shown below:

ON THE TITLE PAGE

[57] ABSTRACT

Line 2, "recovering;" should read --recovering--.
Line 8, "member" should read --member,--.

COLUMN 1

Line 10, "recovering;" should read --recovering--.
Line 20, "From" should read --From a--.
Line 23, "the" should be deleted.
Line 55, "apparatus. A further" should read --apparatus. ¶A further--.

COLUMN 4

Line 16, "28" should read --18--.
Line 23, "$F_m$" should read --$F_M$--.
Line 34, "drop" should read --drops--.

COLUMN 6

Line 19, "generated" should read --generate--.
Line 49, "unit ." should read --unit.--.

COLUMN 9

Line 42, "has" should read --has been--.

UNITED STATES PATENT AND TRADEMARK OFFICE

CERTIFICATE OF CORRECTION

PATENT NO. : 5,486,905 Page 2 of 3

DATED : January 23, 1996

INVENTOR(S) : ATSUSHI TAKEDA, et al.

It is certified that error appears in the above-indentified patent and that said Letters Patent is hereby corrected as shown below:

COLUMN 15

Line 20, "the" should read --The--.
Line 32, "magnet" should read --magnetic--.
Line 49, "surface" should read --surface and--.
Line 50, "$0° \leq \propto \leq 90°$" should read --$0° \leq \alpha \leq 90°$ --; and "$\propto$" should read --$\alpha$--.
Line 52, "$\propto = 0$." should read --$\alpha = 0$.--.

COLUMN 16

Line 37, "$\propto$" should read --$\alpha$--; and "$0° \leq \propto \leq 90°$" should read --$0° \leq \alpha \leq 90°$ --.
Line 39, "$\propto = 0$." should read --$\alpha = 0$.--.

COLUMN 17

Line 41, "$\propto$" should read --$\alpha$--; and "$0° \leq \propto \leq 90°$" should read --$0° \leq \alpha \leq 90°$ --.
Line 43, "$\propto = 0$." should read --$\alpha = 0$.--.

UNITED STATES PATENT AND TRADEMARK OFFICE

CERTIFICATE OF CORRECTION

PATENT NO. : 5,486,905 Page 3 of 3

DATED : January 23, 1996

INVENTOR(S) : ATSUSHI TAKEDA, et al.

It is certified that error appears in the above-indentified patent and that said Letters Patent is hereby corrected as shown below:

COLUMN 18

Line 4, "mens" should read --means--.

Signed and Sealed this

Eighth Day of October, 1996

*Attest:*

Bruce Lehman

BRUCE LEHMAN

*Attesting Officer*

*Commissioner of Patents and Trademarks*